US008342501B2

(12) United States Patent
Yoshimura et al.

(10) Patent No.: US 8,342,501 B2
(45) Date of Patent: Jan. 1, 2013

(54) SHEET FEEDING DEVICE AND IMAGE FORMING APPARATUS WITH A PLURALITY OF SHEET FEED TRAYS

(75) Inventors: Kazutoshi Yoshimura, Hachioji (JP); Kazumichi Yamauchi, Hachioji (JP); Hideki Nakamura, Hachioji (JP); Akira Okamoto, Hino (JP); Yoshiki Katayama, Toyokawa (JP); Masatoshi Ogawa, Hino (JP)

(73) Assignee: Konica Minolta Business Technologies, Inc. (JP)

( * ) Notice: Subject to any disclaimer, the term of this patent is extended or adjusted under 35 U.S.C. 154(b) by 199 days.

(21) Appl. No.: 12/713,340

(22) Filed: Feb. 26, 2010

(65) Prior Publication Data

US 2010/0225047 A1 Sep. 9, 2010

(30) Foreign Application Priority Data

Mar. 5, 2009 (JP) ..... 2009-051623
Dec. 11, 2009 (JP) ..... 2009-282095

(51) Int. Cl.
*B65H 3/44* (2006.01)

(52) U.S. Cl. ..... 271/9.02; 271/9.03; 271/34

(58) Field of Classification Search ..... 271/9.01, 271/9.02, 9.03, 158, 159, 9.05, 90, 301.1, 271/34; 399/23, 391
See application file for complete search history.

(56) References Cited

U.S. PATENT DOCUMENTS

| | | | | |
|---|---|---|---|---|
| 5,028,041 | A * | 7/1991 | Kobayashi | 271/9.03 |
| 7,770,880 | B2 * | 8/2010 | Yamazaki | 271/9.05 |
| 8,104,756 | B2 * | 1/2012 | Bridges | 270/58.07 |
| 2004/0061280 | A1 * | 4/2004 | Sciurba et al. | 271/152 |
| 2007/0047979 | A1 * | 3/2007 | Ai | 399/23 |
| 2009/0166949 | A1 * | 7/2009 | Unno | 271/9.03 |

FOREIGN PATENT DOCUMENTS

| | | | |
|---|---|---|---|
| JP | 10-310285 | A | 11/1998 |
| JP | 2005-234490 | A | 9/2005 |

* cited by examiner

*Primary Examiner* — Jeremy R Severson
(74) *Attorney, Agent, or Firm* — Cantor Colburn LLP

(57) ABSTRACT

There are provided a plurality of sheet feed trays in which sheets are stored, a sheet feeding section which enables a continuous sheet feeding of sheets stored in the above sheet feed tray, and a control section which controls the above sheet feeding section and has an auto tray switch function, and the aforesaid control section obtains information on an amount of sheets stored in the above sheet feed tray, during a continuous sheet feeding from the above sheet feed tray, and judges whether or not the amount of the remaining sheets in the above sheet feed tray satisfies the prescribed condition. In the case where the above prescribed condition is satisfied, the control section stops motion of sheet feeding from the above sheet feed tray while leaving sheets in the above sheet feed tray.

20 Claims, 11 Drawing Sheets

SHEET FEEDING DEVICE AND IMAGE FORMING APPARATUS WITH A PLURALITY OF SHEET FEED TRAYS

This application is based on Japanese Patent Application Nos. 2009-051623 and 2009-282095 filed on Mar. 5, 2009 and Dec. 11, 2009 respectively with Japanese Patent Office, the entire content of which is hereby incorporated by reference.

BACKGROUND OF THE INVENTION

The present invention relates to a sheet feeding device which enables continuous sheet feeding to an image forming apparatus and the like which forms an image on a sheet, and an image forming apparatus provided with the aforesaid sheet feeding device.

When image formation is carried out using an image forming apparatus based on an image data, the image is transferred on the aforesaid sheet by feeding a sheet from a sheet feed tray in which sheets are stored. The aforesaid sheet feed tray is provided in an image forming apparatus. In addition, there also exist an apparatus in which the sheet feed tray is provided in a sheet feeding device separated from the image forming apparatus. Heretofore, when sheets are successively fed from the aforesaid sheet feed tray, in the case where it is required to feed more number of sheets than those in a sheet feed tray, the sheet feeding is continued until the sheet feed tray becomes empty. At this time, there is no intention to leave remaining sheets in a tray, and the issue is how to feed sheets without generating remaining sheets.

Further, there is also proposed a function to continue sheet feeding by switching to another tray having the same settings (a sheet size, a sheet type, and the like) as those of the current tray (an auto tray switch function) in the case where the number of sheets in the current sheet feed tray becomes insufficient. However, also in this case, the switching is carried out after the current sheet feed tray becomes empty.

In general, the sheet feed tray is provided with a sensor to detect existence or nonexistence of a sheet, and when the aforesaid sensor detects that there is no sheet in the tray, it is noticed to urge the operator to refill sheets.

In Unexamined Japanese Patent Application Publication No. H10-310285, a sheet feeding device is disclosed, which is capable of detecting sheets in three levels of number of sheet stored in a sheet feed tray being more than or equal to the prescribed one, less than the prescribed one, and the number of remaining sheet being zero, using a sensor to detect existence or nonexistence of a sheet and an adsorption sensor. That is, when the sheet sensor detects a sheet before and after adsorption of a sheet, the sensor detects that the number of remaining sheets is more than or equal to the prescribed one; when the sheet sensor detects no sheet after adsorption of a sheet, the sensor detects that the number of remaining sheets is less than the prescribed one; and when the sheet sensor detects no sheet before adsorption of a sheet, the sensor detects that the number of remaining sheets is zero. However, even in the above device, in the case where, at a continuous sheet feeding, the number of sheets required exceeds the number of sheets capable of feeding, the sheet feeding is continued until the sheet feed tray becomes empty.

When sheets are refilled after the sheet feed tray becomes empty such as described above, it is generally required to refill sheets of the same kind (such as a sheet type, and a sheet size). But, recently, since, in markets such as a POD (a print on demand) market, a plenty of sheet types exists and various sheet types are used, and further, there exist a trend of a larger apparatus such as a multi-sheet feed unit and increase in the number of sheet feed trays, it becomes difficult to select a required sheet from a plurality of sheet types. Consequently, there exists a case where it is difficult to determine a sheet type (for example, a sheet type, a color, a setting orientation (a back and front, top and end, and left and right)), based only on sheet information displayed on an operation screen of a device, resulting in a different sheet being likely to be set before and after the sheet refill. In particular, for papers for additional printing, coated papers, back side reuse papers, papers for label, processed papers, and the like, when a wrong sheet is set, an image is not formed at an intended part, and as a result, the above paper sheets become wasted ones.

Further, when a sheet feed tray is away from a sheet storage place, it is also difficult in terms of security or quality preservation of a printed sheet to take away printed sheets and bring it to the sheet storage place to compare it with sheets for refilling.

For coping with the problems, an image forming apparatus has been proposed (Unexamined Japanese Patent Application Publication No. 200-234490) in which, when an amount of remaining sheets in a sheet feed tray reaches an appropriate one, printing operation is stopped. In the above image forming apparatus, when a back surface of a sheet, in which printing is completed on one surface, is used for a printing surface, it makes possible for the user to refill right sheets by observing the orientation (upward or downward) of a sheet remained in a sheet feed tray because the above printing operation is stopped. Therefore, based on the above constitution, it becomes possible to confirm, by using a remaining sheet, a sheet type or a sheet size.

However, since in the image forming apparatus, which was disclosed in the above Unexamined Japanese Patent Application Publication No. 2005-234490, the printing operation stops when the number of remaining sheets reaches an appropriate one, the image forming apparatus remains stopped unless a user confirms a sheet in the sheet feed tray. For this reason, unless, for example, a user knows that the apparatus remains stopped, the apparatus remains stopped for a long time, resulting in a problem of significant decrease of production efficiency.

SUMMARY

The present invention was achieved with the view of the above-described circumstances, and an object of the present invention is to provide a sheet feeding device and an image forming apparatus, which allows a user to instantaneously visually confirm a sheet which requires a refill without stopping the apparatus, in the case where, at a continuous sheet feeding, the number of sheet required for sheet feeding exceeds the number of sheet stored in the sheet feed tray.

To be more specifically, the sheet feeding device of an embodiment of the present invention is provided with a plurality of sheet feed trays in which sheets are stored, a sheet feeding section which enables continuous sheet feeding of sheets stored in the above-described sheet feed tray, and a control section which controls motions of the above-described sheet feeding section, and has an auto tray switch function, wherein the aforesaid control section, during a continuous sheet feeding from the above sheet feed tray, obtains information on sheet amount of sheets stored in the above sheet feed tray, and judges whether or not an amount of remaining sheets in the above sheet feed tray meets a prescribed condition. And then, when the above prescribed condition is satisfied as a result of the aforesaid judgment, the control section stops the operation of sheet feeding from the above sheet feed tray while keeping a sheet left in the above sheet feed tray, and in addition. Further, when the above auto tray switch function is effective, the control section starts a sheet feed motion of another sheet feed tray whose settings on sheet information is the same as the above sheet feed tray, as well as stopping the sheet feeding motion of the above sheet feed tray, whereby continuous sheet feeding is continued.

The image forming apparatus of the present embodiment is provided with the sheet feeding device of the present embodiment and the image forming section which forms an image on a fed sheet, wherein the above-described control section controls the motion of the above image forming section and the sheet feeding section.

To be more specific, the image forming apparatus of the present embodiment is provided with a plurality of sheet feed trays in which sheets are stored, a sheet feeding section which enables continuous sheet feeding of sheets stored in the above-described sheet feed tray, an image forming section which forms an image on a fed sheet, and a control section which controls motions of the above-described sheet feeding section and the image forming section, and has an auto tray switch function, wherein the aforesaid control section, during a continuous sheet feeding from the above sheet feed tray, obtains information on sheet amount of sheets stored in the above sheet feed tray, and judges whether or not an amount of remaining sheets in the above sheet feed tray meets a prescribed condition. And then, when the above prescribed condition is satisfied as a result of the aforesaid judgment, the control section stops the operation of sheet feeding from the above sheet feed tray. Further in addition, when the above auto tray switch function is effective, the control Section starts a sheet feeding operation of another sheet feed tray whose settings on sheet information are the same as the above sheet feed tray, as well as stopping the sheet feeding operation of the above sheet feed tray, whereby continuous sheet feeding is continued.

DETAILED DESCRIPTION OF THE PREFERRED EMBODIMENTS

Figure 1:
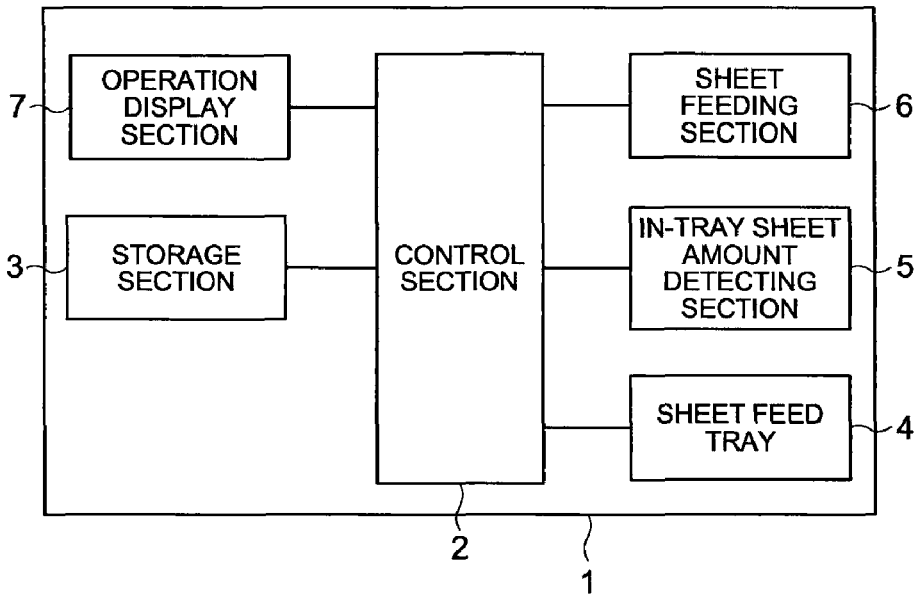
FIG. 1 is a block diagram showing a sheet feeding device of an embodiment of the present invention.

Further, other embodiments of the present invention will be described below.

The sheet feeding device or the image forming apparatus of an embodiment of the present invention can be constituted in such a manner that they are provided with the in-tray sheet amount detecting section, which detects a sheet amount of sheets stored in the above sheet feed tray, and the above-described control section obtains information on a sheet amount of the above sheets by receiving a result of the detection of the in-tray sheet amount detecting section.

Further, the sheet feeding device or the image forming apparatus of an embodiment of the present invention can be constituted in such a manner that the above-described control section obtains information on the above sheet amount by calculating a sheet amount of sheets stored in the aforesaid sheet feed tray from a sheet amount of the sheets which have been fed from the above sheet feed tray, and a sheet amount before the aforesaid sheet feeding.

According to the sheet feeding device or the image forming apparatus of an embodiment of the present invention, whether or not sheet amount of remaining sheets in a sheet feed tray meets a prescribed condition is judged at anytime during continuous sheet feeding from the sheet feed tray. In the case where the prescribed condition is satisfied, the control section can stop an operation of sheet feeding from the aforesaid sheet feed tray while leaving a prescribed sheet amount of sheets in the sheet feed tray. The stop of the sheet feeding operation may be immediately carried out after the prescribed condition is satisfied, or may be carried out after feeding a prescribed sheet amount after the prescribed condition is satisfied. The sheet amount of remaining sheets may be determined based on the prescribed condition itself, or may be set so that the sheets of amount less than the prescribed condition will be left. When the sheet amount of remaining sheets is excessively large, the remaining sheets are left in the tray and another set of sheets is newly placed on them, resulting in the same sheets being left at the bottom of the tray. When the above sheets are used in any occasions, they are likely to be subject to environmental effects to result in a harmful effect on sheet feeding accuracy or output products. Therefore, it is desirable that the number of sheets left in the tray is suppressed to a proper number, and the number is preferably, for example, within about 10 sheets, and more preferably about 1 to 3 sheets. However, the sheet amount of remaining sheets is not limited to a specific one in the present invention.

The sheet amount of sheets in the sheet feed tray can be detected, as described above, for example, by using an in-tray sheet amount detecting section. The in-tray sheet amount detecting section may be any sections as long as they can detect sheet amount in the tray, and they are not limited to specific constitutions in the present invention. The detectable sheet amount may be an amount in which a fixed number of sheets is detected (detection of whether the amount exceeds the prescribed number or is below the prescribed number, or the amount is the prescribed number or not), an amount in which the sheet amount can be successively detected, or an amount in which existence or nonexistence of sheets is detectable. The in-tray sheet amount detecting section may be one type, or may be a section in which the prescribed sheet amount is detected using detection results of the plural types. The sheet amount can be indicated by the number of sheets, a thickness of sheets, or a weight of sheets. The detection methods include ones such as utilizing a change of capacitance, amount of transmittance (such as light and ultrasonic waves), mass, or thickness.

The way of obtaining the information on the remaining sheet amount under the above prescribed condition may be a way to obtain it as the number of sheets as described above, or may be a way of a detection of no-sheet immediately after a detection of a sheet at the in-tray sheet amount detecting section. Since a sheet, which was detected immediately before the no-sheet detection, becomes the final sheet, the final sheet may be arranged to be left in the sheet feed tray. With the above arrangement, the final sheet can be left in the sheet feed tray.

In the case where the sheet feeding section carries out a sheet feeding by air, by arranging an adsorption detection section which detects a sheet adsorbed by air in the vicinity of an air adsorption section which adsorbs a sheet by air, and a section to detect existence or nonexistence of a sheet which detects a sheet in a sheet feed tray prior to air adsorption, it is recognized that the final sheet is adsorbed at the air adsorption section when adsorption is detected at the adsorption detection section, and no-sheet is detected at the section to detect existence or nonexistence of a sheet. At this time, the adsorbed sheet can be left in the sheet feed tray by terminating the adsorbing action at the air adsorption section. With this operation, the final sheet can be certainly left in the sheet feed tray.

Further, since the sheet feeding operation is terminated before a sheet is sent off from a sheet feed tray, damage on the sheet can be prevented.

Information on the sheet amount of sheets in a sheet feed tray can be obtained by computation of the amount at the control section as described above. The control section controls the sheet feeding operation at the sheet feeding section, and can obtain the number of fed sheets. By obtaining the sheet amount before counting the number of fed sheets, the sheet amount of remaining sheets in the sheet feed tray can be computed based on the count of fed sheets. It is possible to obtain the sheet amount before the above count of the number of fed sheets by means such as obtaining the sheet amount which is fully loaded in the sheet feed tray using a proper sensor and the like, and detecting the sheet amount when it reaches the prescribed sheet amount.

Further, in the sheet feeding device or the image forming apparatus of an embodiment of the present invention, when the above prescribed condition is satisfied, a notice of no-sheet, a request of sheet removal, a request of sheet transfer, and a request of sheet refill can be performed via the above control section.

With these functions, when a sheet feeding is stopped while leaving sheets in a sheet feed tray, an operator can immediately know that there is no sheet, and can rapidly carry out a sheet refill.

Since if a sheet remains in a sheet feed tray for a long time, the sheet will be damaged, long time residence of the sheet in the tray can be prevented by urging the remaining sheets to be removed or moved onto a newly placed sheet.

The above notice or request can be constantly performed, but they may be temporarily performed in order to secure a display area of a display section which will be described later. The timing of the temporary performance can be carried out by determining every prescribed number of jobs, every prescribed number of printed sheets, or every prescribed hours. These periods are stored in a memory section, and the above execution timing can be determined by reading the above periods by a control section.

Further, when the sheet refill and the like has been carried out, a setting to remove a state of remaining sheets can be manually carried out, or automatically carried out based on a detection of an increased sheet amount.

Further, the sheet feeding device or the image forming apparatus of an embodiment of the present invention can have a display section, which is controlled by the above control section, and can display information. The aforesaid display section displays a notice of no-sheet, a request of sheet removal, a request of sheet transfer, and a request of sheet refill, whereby visual confirmation of an operator is facilitated. As the display section, any display may be used as long as they display information, and an LCD and the like may be used. In addition to that, one body in which an operation section and a display section are united, which will be described later, may be used. The aforesaid display section is arranged in the main part of the sheet feeding device or in the image forming apparatus, or may be arranged in an external device which is connected to the sheet feeding device.

In the sheet feeding device or the image forming apparatus of an embodiment, the above prescribed condition can be set so that the sheet amount of remaining sheets is less than or equal to the prescribed number of sheets.

With the above setting, the control section can carry out a control of the above stop of sheet feeding operation when the amount of remaining sheets reaches to be less than or equal to the prescribed number.

In the sheet feeding device or the image forming apparatus of an embodiment, settings of the above prescribed condition can be made changeable. With this action, an operator can properly change the above prescribed condition if needed. The aforesaid setting change can be carried out via the control section and the like. With the change of the prescribed condition, for example, the number of remaining sheets can be set to the minimum necessary one, and a situation in which unnecessary many remaining sheets are generated can be prevented.

The setting of the above prescribed condition can be changed for every sheet type. Depending on the sheet types, there may be a difference in difficulty in a distinction by visual confirmation, and then, by making the settings of the prescribed condition for every sheet types possible, working conditions such as confirmation of sheets may be improved.

In the case where sheets are left in the sheet feed tray by the above prescribed condition and when the sheets are removed from the aforesaid sheet feed tray, a sheet feed tray having the same conditions (such as a sheet type, a sheet size, and a setting orientation) may be notified on any sections such as a display section. When a user mistakenly removed the remaining sheets, conditions such as a sheet orientation becomes unknown. However, by performing the above notice, conditions such as a sheet orientation can be confirmed by utilizing a sheet feed tray having the same conditions.

Further, the sheet feeding device or the image forming apparatus of an embodiment can make selection settings possible whether or not to stop the sheet feeding operation while leaving sheets in the above sheet feed tray. With the above action, when a distinction of sheets is easy, or in a circumstance where leaving sheets in a tray is not preferable (such as a very humid environment), it is possible to use all sheets without leaving them in the sheet feed tray. In addition, the above selection setting may be carried out for, for example, every sheet type. With the above action, it is possible, for example, to leave sheets in the sheet feed tray only for sheets whose sheet type distinction is difficult, and for sheets whose sheet type distinction is easy, sheet feeding is performed so that the sheets are not left in the sheet feed tray.

Further, in the sheet feeding device or the image forming apparatus of an embodiment, a setting of a sheet feed tray in which sheets are left and a sheet feed tray in which a sheet is not left when the above prescribed condition is satisfied is carried out for every sheet feed tray. With this, a distinction is made between a sheet feed tray in which remaining sheets is needed, and a sheet feed tray in which remaining sheets is not needed, whereby a necessary and proper control can be performed.

The above setting of prescribed condition and the selection can be carried out by storing condition data and setting data in a nonvolatile storage section, appropriately reading these data, and controlling them by the controlling section. The nonvolatile storage section includes a flash memory, and an HDD, but is not limited to a specific one in the present invention.

In the sheet feeding device or the image forming apparatus of an embodiment, the setting of the above prescribed condition or the selection setting can be inputted, by enabling an operation input at an operation section. The aforesaid operation section may be provided separately from the above display section, or may be constituted of an operation display section in which the operation section is united with the display section. The aforesaid operation display section may be constituted of a touch panel using an LCD. The aforesaid operation section is arranged in the main part of the sheet feeding device or in the image forming apparatus, or may be arranged in an external device which is connected to the sheet feeding device.

Further, the control section of the sheet feeding device or the image forming apparatus of an embodiment has an auto tray switch function. The aforesaid auto tray switch function is a function to continue sheet feeding by switching to another sheet feed tray in which conditions such as a sheet type, a sheet size, and a color are set in the same way as the original tray, when sheets in a sheet feed tray are exhausted while continuous sheet feeding. The auto tray switch is carried out based on a prescribed setting. The aforesaid setting may be the one in which, based on conditions such as the above sheet type or sheet size, the sheet feed tray which meets the conditions is searched out, and as a result of the search, a new tray switched from the current one is determined, or may be the one in which a new tray switched from the current one is previously determined and is set, and, based on the aforesaid setting, the auto tray switch is performed.

When stopping an operation of sheet feeding from the aforesaid sheet feed tray by satisfying the above prescribed condition while leaving sheets in the sheet feed tray, if the setting of the above auto tray switch function is set to be effective, an operation of sheet feeding from another sheet feed tray having the same setting starts, along with stopping the sheet feeding operation of the aforesaid sheet feed tray while leaving sheets in the above sheet feed tray. With this, along with obtaining a visual confirmation effect of sheets by the remaining sheets, a continuing sheet feed operation by the auto tray switch function is secured to result in a good productivity.

In the control section, it is preferable that it is possible to have a setting that the above auto tray switch function is effective or ineffective. In this case, in the control section, it is possible to have a setting that, between jobs and/or during execution of a job, the above auto tray switch function is effective or ineffective in a state of leaving sheets in the above sheet feed tray.

Further in the control section, it may be possible to have a setting that the above auto tray switch function is effective or ineffective in a state of leaving sheets in a sheet feed tray for every sheet feed tray. With this, in the sheet feed tray which has been set to be ineffective, the sheet feeding is stopped while sheets are left in the sheet feed tray, and image forming processing can be discontinued without performing an auto tray switch. On the other hand, in the sheet feed tray which has been set to be effective, the sheet feeding is stopped while sheets are left in the sheet feed tray, and then auto tray switch is performed.

It may be arranged so that it can be decided whether the auto tray switch is executed with or without sheets being left in a sheet feed tray, based on information of a sheet amount of remaining sheets in a sheet feed tray in the course of sheet feeding, the number of sheets unprinted in the current job, and the number of sheets stored in the second sheet feed tray which is the destination of switching.

It is possible to arrange in such a way that, in the case where the number of sheets stored in the second sheet feed tray of the switching destination is more than or equal to the number of sheets unprinted in the current job, and at the same time, the auto tray switch function is effective, a sheet feeding operation by the aforesaid sheet feed tray is carried out without leaving sheets in the above sheet feed tray, and when a sheet runs out in the aforesaid sheet feed tray, the auto tray switch to the above second sheet feed tray is executed.

With this arrangement, when the current job can be completed at the destination of switching, it can be avoided that unnecessary sheets are left in a sheet feed tray.

The sheet feeding section of an embodiment may be the one which controls the above sheet feeing operation with a control section being arranged in the main part of the sheet feeding device, or may be the one which is connected with an external device such as an image forming apparatus, and it is controlled by a control section of the aforesaid external device. The sheet feeding device may be constituted independently of an external device such as an image forming apparatus, and be connected with the external device using an external connection, or may be built in the other apparatus such as an image forming apparatus. As the external device, an image forming apparatus is exemplified as a representative example, but the external device is not limited to it, and includes any devices as long as they require a sheet feed.

Further, the control section of the present invention may be configured such that a control section of a sheet feeding device is arranged in the main part of the sheet feeding device, and an apparatus control section is arranged in an apparatus such as an image forming apparatus, and both of the above control sections work together.

Further, as described above, the structure, equivalent to the sheet feeding devices of the present invention such as a sheet feed tray and a sheet feeding section, may be included as a part of the image forming apparatus. In this case, the control section controls operations such as an image forming operation, in addition to a sheet feeding operation.

An embodiment of the present invention is described below based on appended drawings.

FIG. 1 is a drawing showing a functional block of sheet feeding device 1.

The aforesaid sheet feeding device 1 has control section 2 which controls the whole of sheet feeding device 1. The aforesaid control section 2 is mainly constituted of a CPU and a program which operates the CPU. The aforesaid control device 2 is connected with a storage section 3, and the aforesaid storage section 3 is constituted of memories such as a ROM which stores the above program, a RAM which works as a work area, and a flash memory which stores setting data. Storage section 3 is capable of reading data via control section 2, and the RAM and the flash memory are capable of writing data via control section 2.

Sheet feeding device 1 has sheet feed tray 4, which is controlled by control section 2, and is allowed to feed sheets after sheets are stored in the aforesaid sheet feed tray. Sheet feed tray 4 may be constituted of one tray, or may be constituted of a plurality of trays.

The aforesaid sheet feed tray 4 is equipped with in-tray sheet amount detecting section 5. Aforesaid in-tray sheet amount detecting section 5 is controllably connected with above control section 2, and is constituted so that detection results of in-tray sheet amount detecting section 5 are transmitted to control section 2.

Further, control section 2 is controllably connected with sheet feeding section 6, which feeds sheets by rollers or by sheet feeding by air, and a sheet in sheet feed tray 4 is taken out by aforesaid sheet feeding section 6 and fed to a prescribed destination.

Control section 2 has an auto tray function, and can continues sheet feeding by above sheet feeding section 6 by automatically switching to a sheet feed tray of the same conditions such as a sheet type and a sheet size, in the case where the aforesaid function is in effect, and under conditions such as running out of sheets.

Further, control section 2 is controllably connected with operation display section 7, and aforesaid operation display section 7 is capable of displaying proper information via a control of control section 2 as the display section of the present embodiment. In addition, at operation display section 7 as the operation section of the present embodiment, an operator can perform an inputting operation.

Next, operations of the sheet feeding device will be described based on the above block drawing.

The above storage section 3 stores operation parameters of sheet feeding device 1, and further stores sheet information of each sheet feed tray (such as a sheet type, a sheet size, and a basis weight of a sheet). In addition, storage section 3 stores data of prescribed condition, whose data stop an operation of sheet feeding from a sheet feed tray during a continuous sheet feeding. The aforesaid data of prescribed condition are allowed to be set and inputted through above operation display section 7, and further the setting is allowed to be changed through aforesaid operation display section 7 after the above setting, as well as the data being previously stored in storage section 3. As the above prescribed condition, a plurality of conditions may be determined depending on conditions such as ones for every sheet type, and in this case, prescribed conditions which are used are selected based on a sheet type. In the case where sheets are left in amount less than that of the prescribed condition, a case may exist where, after a judgment is made that the prescribed condition is satisfied, an operation parameter to leave sheets in a prescribed sheet amount (for example, the number of sheets to be fed after the judgment) is set.

In storage section 3, a setting whether sheets are left or not when a sheet amount of sheets in a sheet feed tray becomes insufficient during a continuous sheet feeding is allowed to be stored. The aforesaid setting can be performed for every sheet feed tray. Further, in storage section 3, a setting whether the above auto tray switch function is effective or ineffective, for a case of leaving sheets, can be stored. The aforesaid setting can be executed for every sheet feed tray.

Control section 2 decides, according to the above setting, whether or not an operation of sheet feeding from the aforesaid sheet feed tray is stopped while sheets are left in a sheet feed tray, and whether or not an auto tray switch is carried out, at the time of leaving sheets described above. The above setting may be done so that the setting is allowed to be made as a mechanical operation, or may be done so that the above setting can be performed for every sheet feeding job. Further, the above setting, whether sheets are left or not, or whether an auto tray switch is carried out or not, can be performed for every sheet type and the like.

In control section 2, when the above prescribed condition is satisfied, it is possible to make a setting whether sheets are left or not, based on the number of remaining sheets of the job during printing. The aforesaid setting data are stored in the above storage section 3 so as to be able to be read. In the aforesaid control, the number of remaining sheets in a sheet feed tray is subtracted from the number of sheets unprinted in the current job when the sheets are left in the tray, and when the above subtracted number is less than or equal to the number of sheets stored in the second sheet feed tray of switching destination by the auto tray switch, it is possible not to leave sheets in the tray, and when the subtracted number of sheets are more than the above number of sheets stored, sheets are left in the tray. The reason for this is that, if the current job can be completed at the destination of switching by the auto tray switch, the necessity of leaving sheets in the tray is low.

In control section 2, a sheet feeding operation is controlled via an operation parameter in above storage section 3, and the like. In aforesaid control, sheets are fed from sheet feed tray 4 by controlling sheet feeding section 6. At this time, also in sheet feed tray 4, controls such as raising an elevation tray is performed. In sheet feeding section 6 and sheet feed tray 4, a continuous sheet feeding via a control of control section 2 is possible.

In-tray sheet amount detecting section 5 can successively or at appropriate times detects a sheet amount in a sheet feed tray, and the aforesaid detection results are transmitted to the above control section 2. Control section 2 receives the above detection results, reads prescribed condition which is stored in storage section 3, and by comparing the above conditions, judges whether or not an amount of sheets in the tray satisfies the prescribed condition. In the case where the prescribed condition is not satisfied, a continuous sheet feeding is continued. When the prescribed condition is satisfied, sheet feeding section 6 is stopped while leaving sheets in sheet feed tray 4, and an operation of sheet feeding from sheet feed tray 4 is stopped. The sheet amount of remaining sheets is, as described above, left to be the prescribed condition itself, or the number less than the above.

In sheet feeding device 1, when an auto tray switch is set to be effective, along with a stop of an operation of sheet feeding from above sheet feed tray 4, sheet feeding from a new sheet feed tray after switching is started and the sheet feeding is continued in the case where there is a sheet feed tray having the same settings. The setting whether the above auto tray switch function is effective or ineffective is possible by operation display section 7, and while contents of the settings is being stored in storage section 3, execution or no execution of the above function is decided by reading the above contents of the settings by control section 2. Whether or not there is a sheet feed tray of the same settings is judged by reading contents of the settings of each sheet feed tray from storage section 3. Differing from it, it may be arranged that a new tray after switching by the auto tray switch is previously set.

In the case where there is no sheet feed tray of the same settings, or in the case where an auto tray switch function is ineffective, a starting operation of sheet feeding with the other sheet feed tray is not carried out, when an operation of sheet feeding from above sheet feed tray 4 is stopped.

When a sheet feeding operation from sheet feed tray 4 is stopped with the above prescribed condition being satisfied, control section 2 can display, on operation display section 7, a notice that sheets are running out, and at that time, can display of urging sheet refill. An operator can start the sheet refill operation, when the operator sees the notice. Further, at that time, sheet types in a sheet feed tray can be confirmed through operation display section 7, and at the same time, by confirming remaining sheets in sheet feed tray 4, sheets of the same sheet type can be swiftly and correctly refilled in sheet feed tray 4.

If the above state where sheets are left in the tray continues, it is possible that control section 2 controls a display to require removal of sheets, or to require sheet transfer so as to move the remaining sheets onto the upper part of the stored sheets at every opportunity depending on number of jobs or printings which are previously set or the amount of time elapsed.

Figure 2:
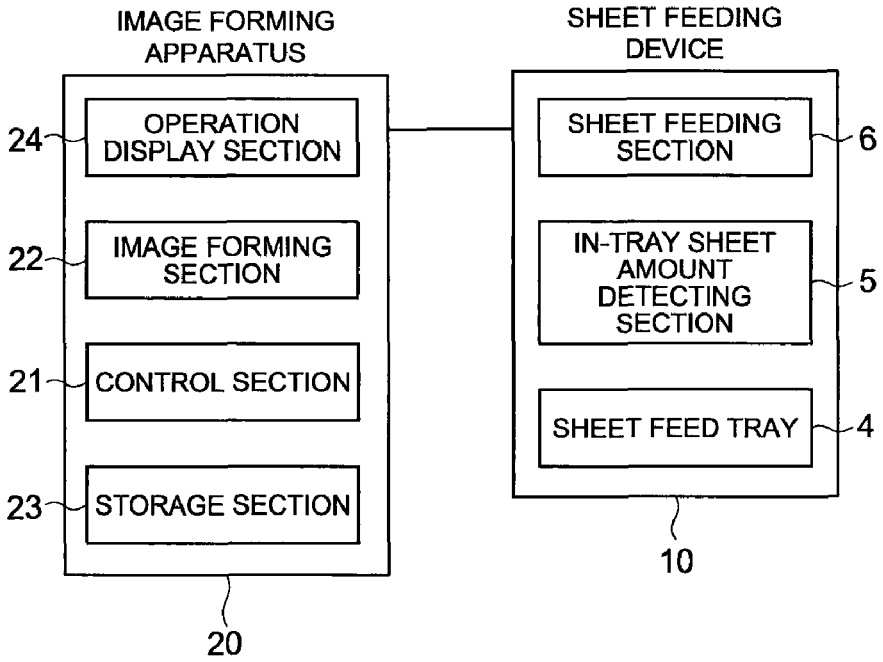
FIG. 2 is a block diagram showing a sheet feeding device of another embodiment of the present invention.

In the above descriptions, a constitution is described in which sheet feeding device 1 is independently arranged, and control section 2 is also equipped within the sheet feeding device. In the followings, an example is described in which sheet feeding device 10 is connected with an external apparatus (in this embodiment, image forming apparatus 20). FIG. 2 is a drawing showing a functional block of sheet feeding device 10 and image forming apparatus 20 which is connected with the sheet feeding device 10. In this embodiment, any constituent element which also appears in the above embodiment will be denoted by the same numerals, and their descriptions will be omitted or simplified.

In the aforesaid connection, sheet feeding device 10 is mechanically connected with image forming apparatus 20 so that sheets can be fed from sheet feeding device 10 to image forming apparatus 20, and at the same time, they are electrically connected with each other so that transmission and reception of signals between them can be carried out.

Sheet feeding device 10 has sheet feed tray 4, and aforesaid sheet feed tray 4 is equipped with in-tray sheet amount detecting section 5. Further, sheet feeding device 10 is provided with sheet feeding section 6, and via aforesaid sheet feeding section 6, sheets in sheet feed tray 4 are taken out and fed to image forming apparatus 20.

On the other hand, image forming apparatus 20 has control section 21 which controls the whole of image forming apparatus 20 and sheet feeding device 10, and aforesaid control section 21 is mainly constituted of a CPU and a program which operates the CPU. Control section 21 is connected with storage section 23, and the aforesaid storage section 23 is constituted of such as a ROM which stores the above program, a RAM which works as a work area, and a flash memory which stores setting data. Storage section 23 is capable of reading data via control section 21, and the RAM and the flash memory are capable of writing data via control section 21. Control section 21 is electrically connected with sheet feeding device 10 to be capable of control of sheet feeding section 6 and sheet feed tray 4 of sheet feeding device 10. Further control section 21 receives detection results of in-tray sheet amount detecting section 5.

Further, image forming apparatus 20 is provided with image forming section 22, which carries out image formation based on image data, and is controllably connected with above control section 21. Aforesaid image forming section 22 is constituted of a photoreceptor, a writing section, a transfer section, a fixing section, and the like, all of which are not illustrated. An image formed on the photoreceptor is transferred by the transfer section to a sheet, which is fed from a sheet feeding device, after which the image is fixed by the fixing section. The aforesaid sheet can be suitably subjected to post processing such as stapling via a post processing section incorporated in an image forming apparatus or a post processing apparatus connected with an image forming apparatus.

In image forming apparatus 20, aforesaid operation display section 24 is controllably connected with control section 21. Aforesaid operation display section 24 is capable of displaying proper information as the display section of the present embodiment via control of above control section 21. In addition, at operation display section 24, as the operation section of the present embodiment, an operator can perform an inputting operation. At aforesaid operation display section 24, in the similar manner to above operation display section 7, various information displays or inputting of settings in sheet feeding device 10 can be carried out.

In this embodiment, operations of the sheet feeding device is similar to those of the above embodiment except that a control of sheet feeding device 10 is carried out at control section 21 of image forming apparatus 20.

Figure 3:
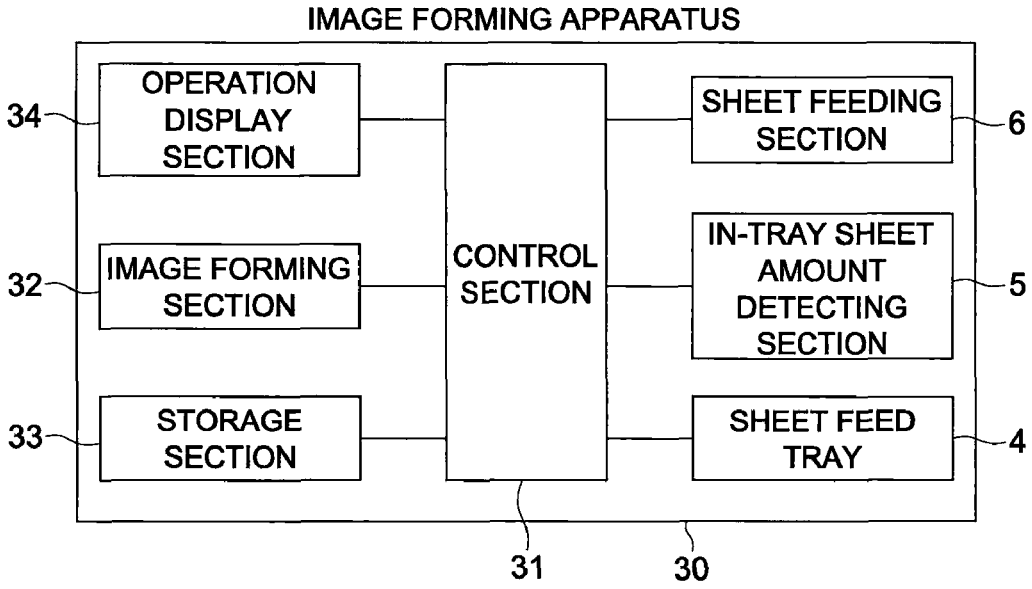
FIG. 3 is a block diagram showing an image forming apparatus of another embodiment of the present invention.

Next, image forming apparatus 30, in which a constitution equivalent to a sheet feeding device is incorporated, will be described based on FIG. 3. FIG. 3 is a functional block diagram of aforesaid image forming apparatus 30.

Image forming apparatus 30 has control section 31 which controls the whole of image forming apparatus 30, and aforesaid control section 31 is constituted of a CPU and programs which operate the CPU.

Control section 31 is connected with storage section 33, and the aforesaid storage section 33 is constituted of such as a ROM which stores the above programs, a RAM which works as a work area, and a flash memory which stores setting data. Storage section 33 is capable of reading data via control section 31, and the RAM and the flash memory are capable of writing data via control section 31.

Above control section 31 is controllably connected with sheet feed tray 4, and aforesaid sheet feed tray 4 is provided with in-tray sheet amount detecting section 5. Detection results of in-tray sheet amount detecting section 5 are transmitted to control section 31.

Control section 31 is, further, controllably connected with sheet feeding device 6. Image forming apparatus 30 is provided with image forming section 32 which carries out image formation based on image data, and is controllably connected with above control section 31. Aforesaid image forming section 32 is, in the similar manner to the above embodiment, constituted of a photoreceptor, a writing section, a transfer section, a fixing section, and the like, all of which are not illustrated.

In image forming apparatus 30, control section 31 is controllably connected with operation display section 34. Operation display section 34 is capable of displaying proper information as the display section of the present embodiment via control of above control section 31. In addition, at operation display section 34, as the operation section of the present embodiment, an operator can perform an inputting operation.

Also in this embodiment, operations of the sheet feeding device is similar to those of the above embodiment except that a control regarding the sheet feeding is carried out at control section 31 of image forming apparatus 30.

Figure 4:
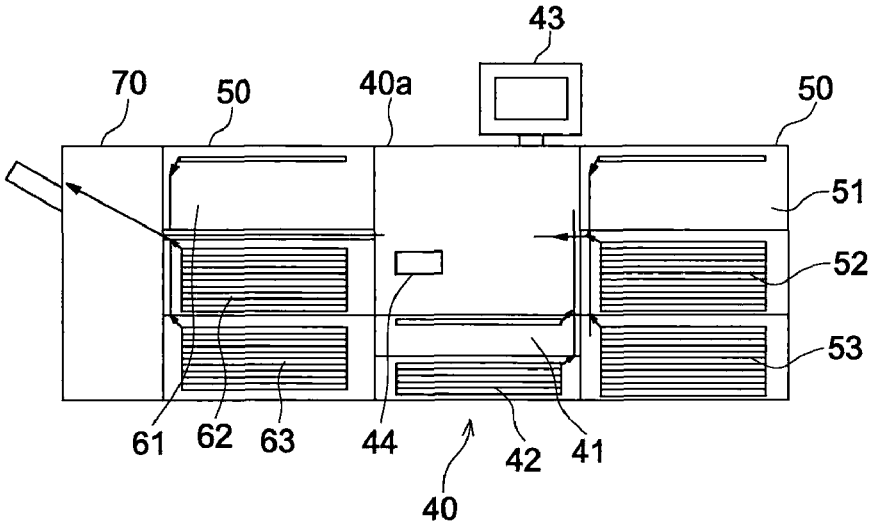
FIG. 4 is a schematic view of the present invention showing an image forming apparatus of another embodiment.

Further, FIG. 4 shows a schematic constitution of an image forming apparatus of another embodiment.

In aforesaid image forming apparatus 40, sheet feeding device 50 is externally connected with the body of image forming apparatus 40*a*. On the downstream side in the sheet conveying direction of the body of image forming apparatus 40*a*, insertion device 60 is connected with the body of image forming apparatus 40*a*. On the downstream side in the sheet conveying direction of insertion device 60, post processing device 70, which carries out stapling, punching, and the like, is connected with the insertion device 60. The body of image forming apparatus 40*a* is provided with operation display section 43, which is equivalent to the display section and the operation section of the present embodiment.

Sheet feeding device 50 is provided with sheet feed trays 51, 52, and 53. The interior of the body of image forming apparatus 40*a* is provided with sheet feed trays 41 and 42. Further, insertion device 60 is provided with sheet feed trays 61, 62, and 63. In this embodiment, the sheet feeding devices of the present embodiment are constituted of sheet feeding device 50, which is provided with sheet feed trays 51, 52, and 53, and an interior structure of inside of the body of image forming apparatus 40*a*, which is provided with sheet feed trays 41, and 42. Control section 44 is equipped inside the body of image forming apparatus 40*a*. Therefore, even when the auto tray switch is carried out, switching of tray among sheet trays 41, 42, 51, 52, and 53 can be carried out. Control of remaining sheets or the auto tray switch can also be carried out using insert device 60 having sheet feed trays 61, 62, and 63 as the sheet feeding device of the present embodiment. At this time, the auto tray switch is carried out among sheet feed trays 61, 62, and 63.

Next, a constitution of the above sheet feed tray and the sheet feeding section will be described, and the sheet feeding control in the sheet feed tray and the sheet feeding section will be described. In this example, the sheet feeding section performs a roller sheet-feeding.

Figure 5A:
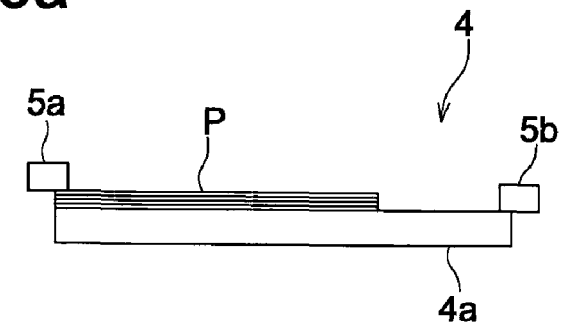
FIGS. 5*a* and 5*b* are illustrations of the present invention showing an example of a sheet feed tray and an in-tray sheet amount detecting section.
Figure 5B:
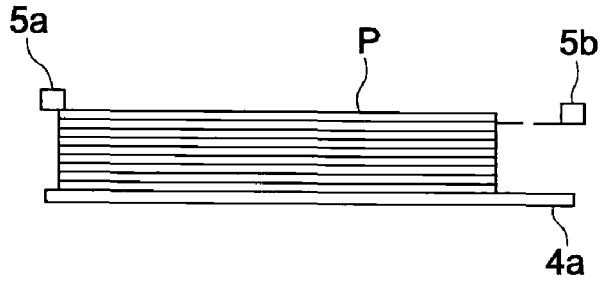

FIG. 5*a* shows a schematic diagram of an example of the sheet feed tray and the in-tray sheet amount detecting section.

Sheet feed tray 4 is provided with elevation tray 4*a* which sustains sheets and rises accompanying the sheet feeding. The rise of aforesaid elevation tray 4*a* can be carried out by an urging force of an elastic member or a motion of an actuator which are not illustrated. In the upper part of aforesaid elevation tray 4*a*, there is arranged upper limit detection sensor 5*a* for detecting the upper limit of sheet P, which is loaded on elevation tray 4*a*, and elevation tray 4*a* rises so that aforesaid upper limit detection sensor 5*a* detects the sheet to prepare for sheet feeding. In addition, in the upper part of elevation tray 4*a*, there is arranged elevation tray detection sensor 5*b* at a prescribed fixed position for detecting arrival of the upper surface of elevation tray 4*a*. The in-tray sheet amount detecting section of the present embodiment is constituted of these upper limit detection sensor 5*a* and elevation tray detection sensor 5*b*.

Control section 2, 21, or 31 (hereinafter, numerals are omitted) judges that, in a state where a sheet is detected by above upper limit detection sensor 5*a*, and elevation tray 4*a* is not detected by elevation tray detection sensor 5*b*, elevation tray 4*a* has not risen to the prescribed position. When a detection position by elevation tray detection sensor 5*b* is properly fixed, a sheet amount of sheets in sheet feed tray 4 can be detected. To be more specific, as shown in FIG. 5*a*, when a state that a sheet is detected by above upper limit detection sensor 5*a*, and elevation tray 4*a* is detected by elevation tray detection sensor 5*b* is achieved, it means that the current state is that elevation tray 4*a* has risen to the prescribed position to have prepared for the sheet feeding. As a result, it is found that sheets are stored in sheet feed tray 4 having a thickness corresponding to a difference between a position detected by upper limit detection sensor 5*a* and a position detected by elevation tray detection sensor 5*b*.

When a detection position of elevation tray detection sensor 5*b* is set so that a difference between detection positions of the upper limit detection sensor and of the elevation tray detection sensor 5*b* may be equal to a thickness of sheets of the prescribed number, the remaining sheets having the prescribed number can be detected. If the above difference is equal to a piece of sheet, it can be detected that a piece of sheet is loaded on elevation tray 4*a*.

Figure 6:
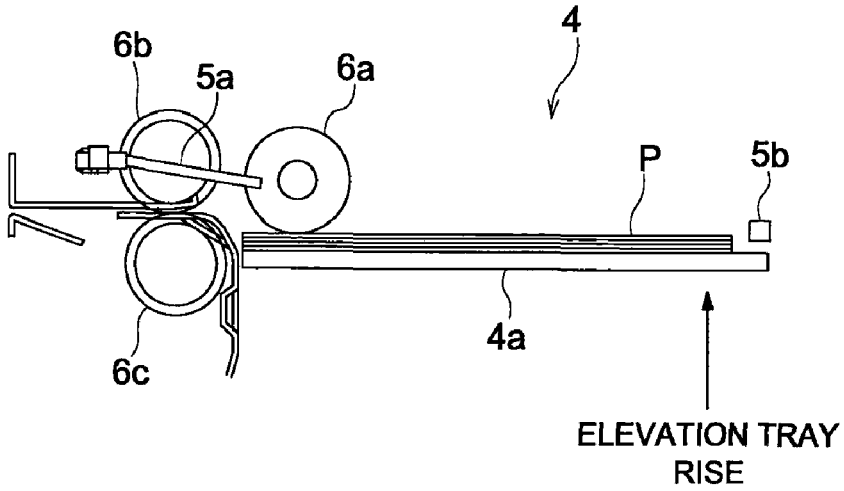
FIG. 6 is an illustration of the present invention showing an example of a specific constitution of a sheet feed tray and an in-tray sheet amount detecting section.

FIG. 6 shows a specific example of a constitution of a sheet feed tray having the above elevation tray and sensors.

In the upper position of elevation tray 4*a*, there is arranged pickup roller 6*a* for taking out a sheet by rotation with being in contact with sheet P which is stored in sheet feed tray 4. In the taking-out direction of aforesaid pickup roller 6*a*, there is arranged sending-out roller 6*b*, which sends out the sheet taken out by pickup roller 6*a*. Further, at a position where a pressure-contact with above sending-out roller 6*b* is achievable, there is provided handling roller 6*c*, which separates sheets with being overlapped with one another by rotation in the direction of returning a sheet. These pickup roller 6*a*, sending-out roller 6*b*, and handling roller 6*c* constitute a part of sheet feeding section 6 of the present embodiment.

Above pickup roller 6*a* is arranged so that it can move to a position slightly lower than a sheet taking-out position, and, at the time of sheets feeding, is pushed up by a rise of elevation tray 4*a* through an upper surface of sheets. A lever of upper limit detection sensor 5*a* is connected with above pickup roller 6*a*, and when pickup roller 6*a* is pushed up to reach the taking-out position, the upper limit position is detected by aforesaid upper limit detection sensor 5*a*. Then, the rise of elevation tray 4*a* is stopped by the control section which received the above detection result, whereby the uppermost sheet is placed at the taking-out position.

Aforesaid sheet P is taken out by rotation of pickup roller 6*a*, and sent out by sending-out roller 6*b*, and, at the same time, sheets taken out with being overlapped with the sheet P are sent back by handling roller 6*c*. When a sheet is sent out, the height of pickup roller 6*a* is lowered, then, elevation tray 4*a* rises and is detected again by upper limit detection sensor 5*a*, and then, the rise of elevation tray 4*a* is stopped, whereby the uppermost sheet is placed at the taking-out position. On the other hand, elevation tray detection sensor 5*b* is arranged in such a manner that the detection position is located at a lower position than the detection position of the uppermost sheet of above upper limit detection sensor 5*a* with a prescribed difference (a thickness of the prescribed number of sheets) being provided between the detection positions of the sensors. The above prescribed number of sheets is equivalent to the prescribed condition of the present embodiment.

In the control section, a remaining sheet setting is made prior to a continuous sheet feeding. The aforesaid remaining sheet setting may be decided as an initial setting, and stored in the storage section, or may be made at an appropriate time by selecting a remaining sheet setting mode from a menu.

Figure 7A:
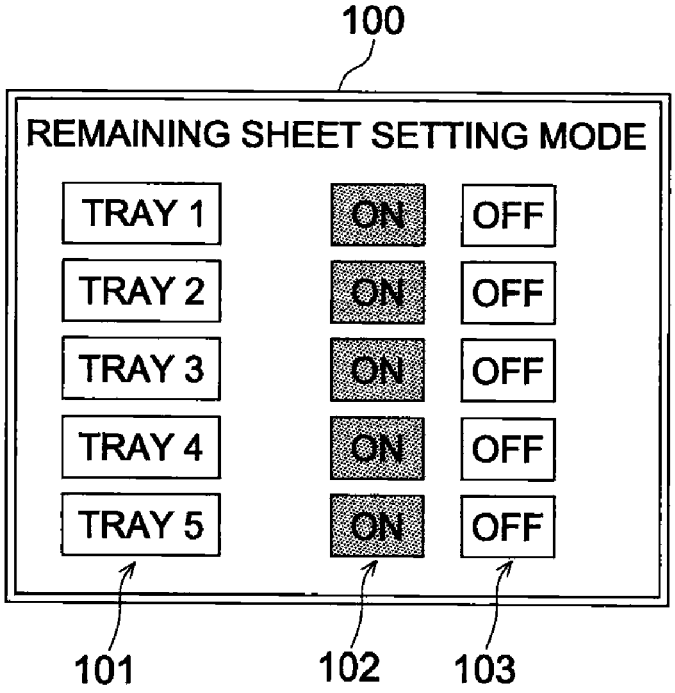
FIGS. 7*a* and 7*b* are illustrations of an embodiment of the present invention showing a remaining sheet setting screen and an auto tray setting screen at an operation display section.

FIG. 7*a* shows a state that remaining sheet setting mode screen 100 is displayed in the operation display section.

In remaining sheet setting mode screen 100, there is provided tray display column 101, which displays the tray numbers corresponding to each sheet feed tray, and further, corresponding to each tray number, ON button group 102 and OFF button group 103 are displayed. In ON button group 102 and OFF button group 103, corresponding to each tray number, it is arranged to enable an individual operation input. When any one of the ON buttons is pushed, the remaining sheet control of the corresponding sheet feed tray becomes effective, and when any one of the OFF buttons is pushed, the remaining sheet control of the corresponding sheet feed tray becomes ineffective. In this way, by enabling the remaining sheet setting for each tray, it is possible to leave the remaining sheets for confirmation of the sheet setting regarding a sheet in which a sheet setting orientation is prescribed such as, for example, a printed paper to be reprinted, and not to leave unnecessary remaining sheets for a sheet feed tray where remaining sheets are unnecessary.

Figure 7B:
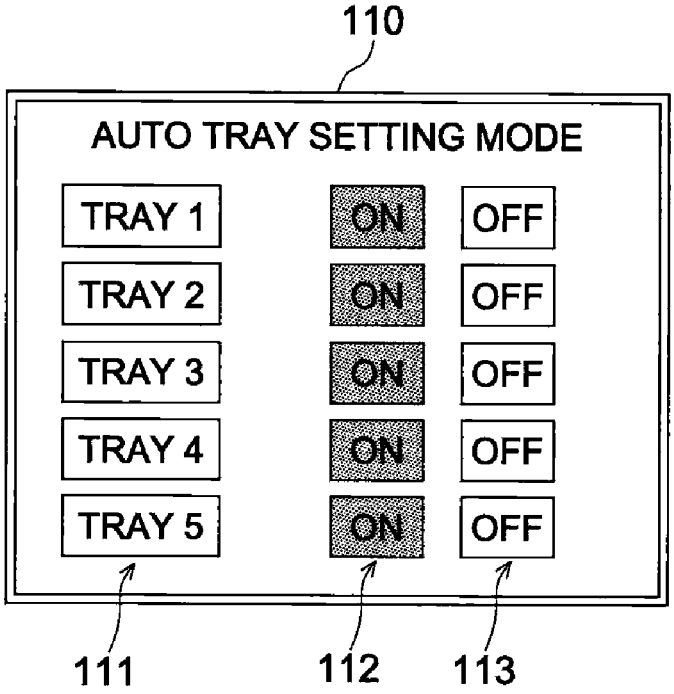

FIG. 7*b* shows a state that auto tray setting mode screen 110 is displayed in the operation display section.

In auto tray setting mode screen 110, there is provided a tray display column 111 which displays the tray numbers corresponding to each sheet feed tray, and further, corresponding to each tray number, ON button group 112 and OFF button group 113 are displayed. In ON button group 112 and OFF button group 113, it is arranged to enable an individual operation input. When any one of the ON buttons is pushed, the auto tray function of the corresponding sheet feed tray becomes effective, and when any one of the OFF buttons is pushed, the auto tray function of the corresponding sheet feed tray becomes ineffective.

Figure 8:
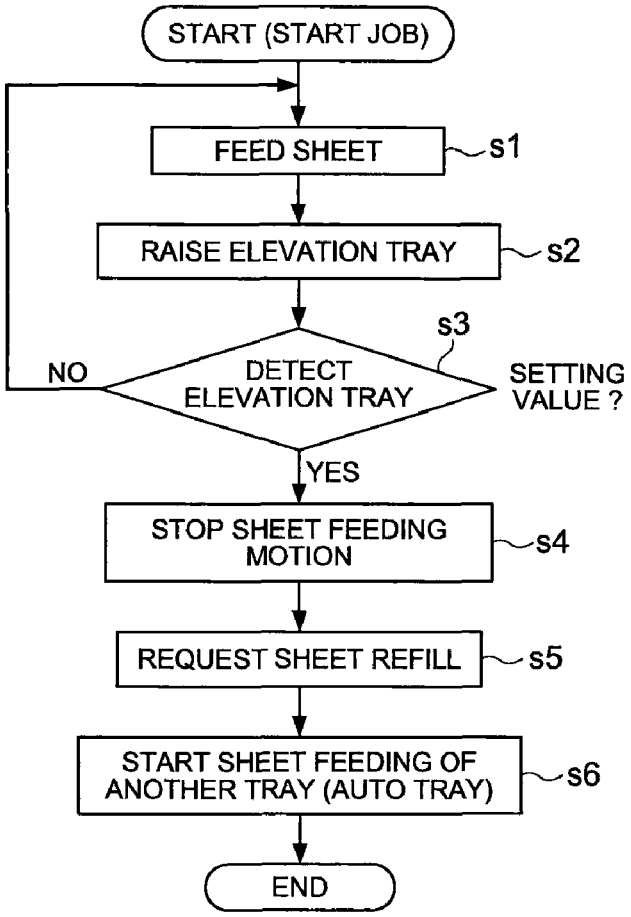
FIG. 8 is a flowchart of an embodiment of the present invention showing steps of a sheet feeding and a stop of sheet feeding at a roller sheet feed, and an auto tray switch.

Next, regarding steps of sheet feeding and a stop of sheet feeding in the above sheet feed tray, and the auto tray, the control steps by the control section will be described with referring to the flow chart of FIG. 8.

Accompanying a continuous sheet feeding, as described above, sending out of sheets (sheet feeding) by the sheet feeding section is carried out (step s1), and accompanying the sending-out of a sheet, elevation tray 4*a* rises (step s2). When elevation tray 4*a* rises one after another, whether or not the uppermost surface of elevation tray 4*a* reaches the detection position is detected by elevation tray detection sensor 5*b* (step s3). If elevation tray 4*a* is not detected by elevation tray detection sensor 5*b* (step s3, NO), since sheets exceeding the prescribed number are stored, the above sheet feeding (step s1) and a rise of the elevation tray (step s2) are repeated.

Figure 9:
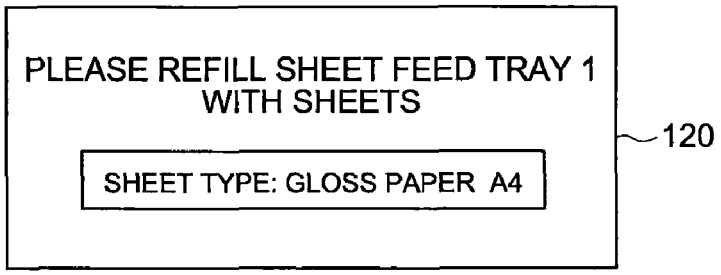
FIG. 9 is an example of an image which displays a request of sheet refill at an operation display section of the present invention.

On the other hand, accompanying a rise of elevation tray 4*a*, when elevation tray 4*a* reached a position where it is detected by elevation tray detection sensor 5*b* (step s3, YES), the number of stored sheets in sheet feed tray 4*a* is equal to the prescribed number. For this reason, the control section judges that the number of sheets in the sheet feed tray satisfies the prescribed condition, and then, stops the operation of sheet feeding section 6 (step s4). Further, the control section, as shown in an example of FIG. 9, displays a request of sheet refill on operation display section 7 and the like (step s5). At this time, a sheet type can be displayed on the operation display section. An operator who sees the display can rapidly refill sheets while confirming remaining sheets in sheet feed tray 4.

Regarding a sheet feed tray in which sheets have been left, data showing the tray being in a state where sheets are left are stored in a storage section. With this, the control section carries out a control on the assumption that the tray is in a state where sheets are left. In the case where it is detected that sheets are refilled in a tray in which the sheets are left, data showing a state where sheets are left are deleted, or other action is taken.

In the case where a tray becomes a state where sheets are left, a message may be periodically displayed to urge treatment of the remaining sheets. For example, a message such as "Please remove remaining sheets in tray x." to urge to remove remained sheets is displayed on an operation display screen.

In addition, for example, a message such as "Please transfer remaining sheets in tray x to the upper position." is displayed on an operation display screen to urge to transfer the remaining sheets.

The displaying timing includes, for example, after a progress of 50 jobs with the same sheet type setting, and after a lapse of 3 days with the same sheet type setting.

In the case where the remaining sheets are taken away by a mistake in the above state where sheets are left, the sheet setting orientation becomes unclear. Then, by displaying a message such as "Regarding a tray setting, please refer to tray X.", a tray having the same setting is notified of by a message.

As a judgment of remaining sheets having been removed, for example, a case is cited where a detection of existence or nonexistence of a sheet in a tray determines that there is no sheet, in a state of a setting of leaving remaining sheets in a tray.

Along with a stop of sheet feeding after the above operation of leaving sheets, an auto tray switch is executed (step s6).

Figure 10:
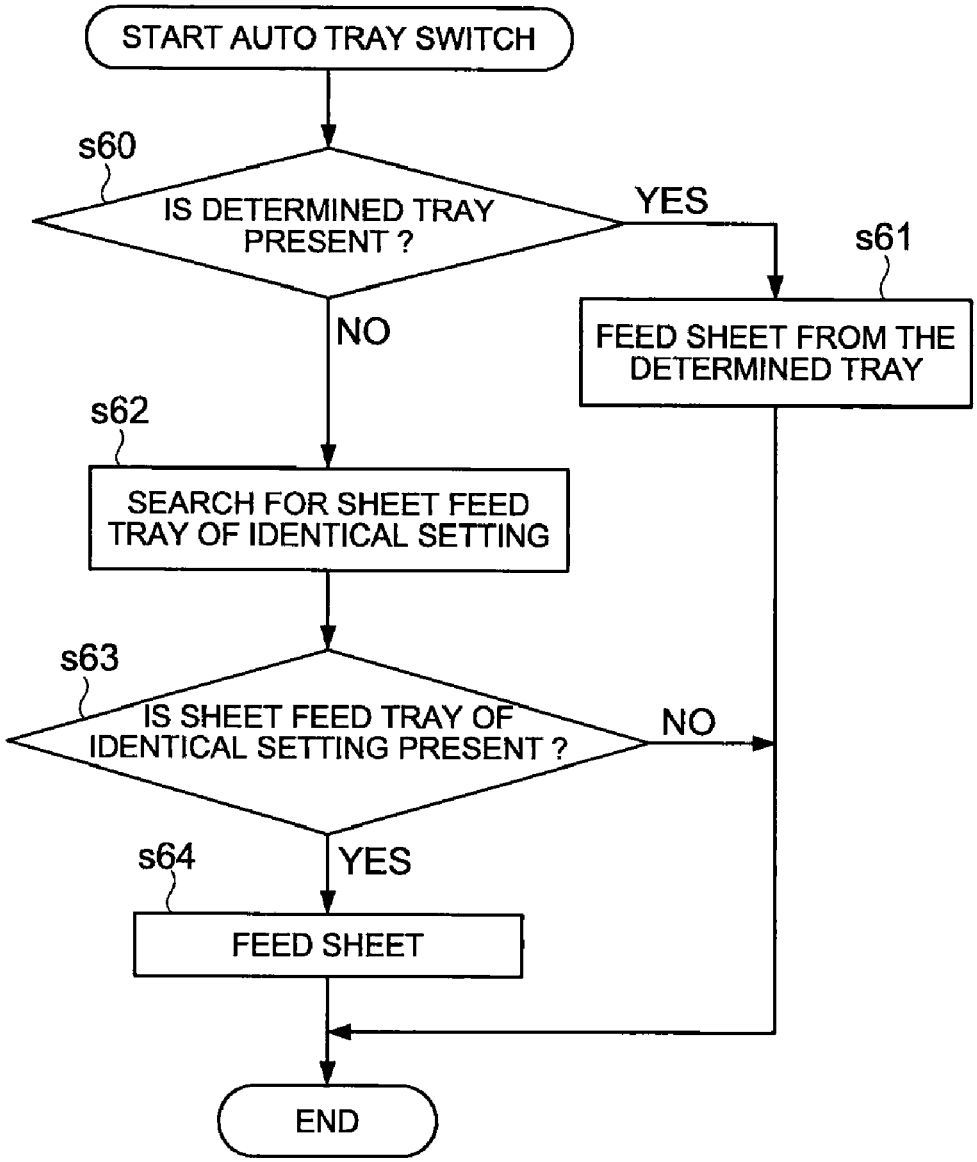
FIG. 10 is a flowchart of an embodiment of the present invention showing detailed steps of an auto tray switch.

Steps of the auto tray switch are described with reference to the flowchart of FIG. 10.

At the time of start of the auto tray switch, it is judged whether or not a new tray after switching is set as a determined tray (step s60). If the determined tray is set (step s60, YES), sheet feeding from the aforesaid determined tray starts (step s61), to result in stop of the present steps. On the other hand, when the determined tray is not set (step s60, NO), a sheet feed tray having the same settings (such as a sheet type, a sheet size, and a color) as the sheet feed tray in which sheets are left is searched for (step s62). At this time, the search is carried out according to the priority order which has been set. If there is no sheet feed tray having the same settings (step s63, NO), the steps are finished without an auto tray switch. If there is a sheet feed tray having the same settings (step s63, YES), sheet feeding starts after switching to the corresponding sheet feed tray (step s64).

In other words, in the present embodiment, the aforesaid sheet feed tray stops while leaving sheets, but the sheet tray is switched to another tray having the same sheet type by the auto tray switch function, and as a result, image formation is continued.

For example, in above image forming apparatus 40, assuming that an identical sheet type of sheets are stored in sheet feed trays 41 and 42 which are equipped to the body of image forming apparatus 40*a*, another identical sheet type of sheets are stored in sheet feed trays 51, 52 and 53 in sheet feeding device 50, and further another identical sheet type of sheets are stored in sheet feed trays 61, 62 and 63 in insertion device 60, when sheet feeding from sheet feed trays 41, 51 and 61 is executed, in a conventional control, a sheet feeding operation of the corresponding tray stops when the number of remaining sheets in any one of sheet feed trays 41, 51 and 61 reached a setting value. And image formation does not carried out until sheets are refilled and the operation is started again.

However, with the above control of the present embodiment being carried out, for example, in the case where, between sheet feed trays 41 and 42, the number of remaining sheets of sheet feed tray 41 reaches a setting value, the sheet feeding from sheet feed tray 41 stops, and a sheet feeding from sheet feed tray 42 starts by an auto tray switch.

At this time, by confirming remaining sheets in sheet feed tray 41, a proper sheet setting can be achieved without stopping the machine. The similar control can be carried out for sheet feed trays 51 to 53, and sheet feed trays 61 to 63.

In the above embodiment, it is assumed that both detection results of an upper limit detection sensor and an elevation tray detection sensor are used for a detection of a sheet amount of sheets in a sheet feed tray. However, as the invention of the present application, obtaining information of the above sheet amount is not limited to the above constitution, but various constitutions can be used as the in-tray sheet amount detecting section 5. Therefore, as a matter of course, a constitution composed of one type of sensor may be used.

For example, if an amount of rise of the above elevation tray can be obtained by an amount of operation of an actuator and the like, a sheet amount of remaining sheets can be calculated from a difference between the position of the above elevation tray and a detection position of an upper limit detection sensor.

Figure 11A:
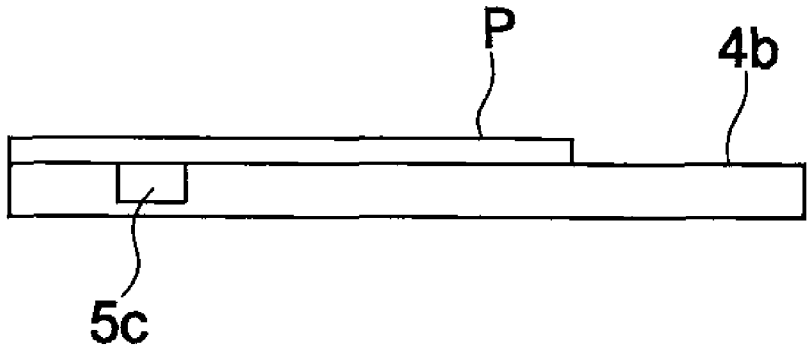
FIGS. 11*a* and 11*b* are altered examples of the present invention showing an in-tray sheet amount detecting section.
Figure 11B:
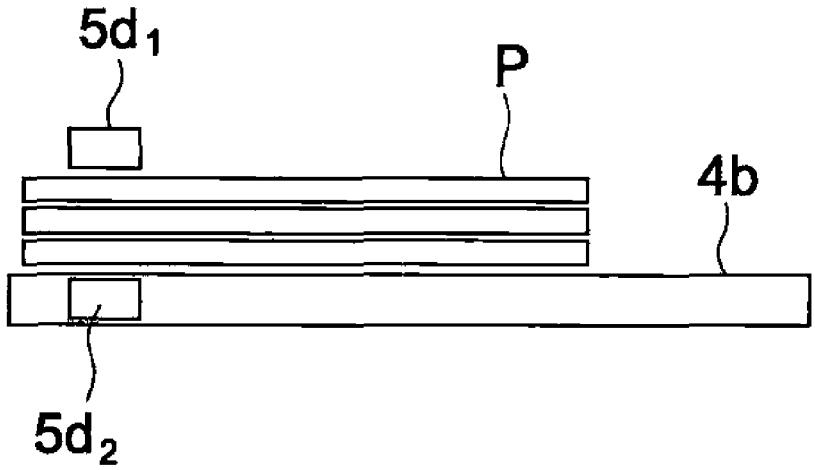

Further, FIGS. 11*a* and 11*b* show altered examples of the aforesaid sheet amount detecting section in a sheet feed tray. FIG. 11*a* shows one of the altered examples in which sheet loading base 4*b* (it can be elevation tray 4*a*) is equipped with weight detection sensor 5*c* such as a piezoelectric element, which detects a weight, and the like, as the in-tray sheet amount detecting section 5. Aforesaid weight detection sensor 5*c* is provided so that the mass of sheet P loaded on sheet loading base 4*b* is added to the sensor, and then, the weight corresponding to the sheet amount is detected. In the control section, the sheet weight may be used as a ground as the prescribed condition, or by calculating the number of detected sheets from the detected weight of sheet stack and the basis weight of a sheet, and then the calculated number may be compared with the number set as the prescribed condition.

Next, FIG. 11*b* shows another one of the altered examples in which transmitting element 5*d*1 and receiving element 5*d*2 are arranged so that they are located above and below the sheets loaded on sheet loading base 4*b*, and which is made to detect the remaining amount of sheet P from an amount of light or ultrasonic waves, which was outputted from transmitting element 5*d*1 toward receiving element 5*d*2 and received by the receiving element 5*d*2. Also in this configuration, when a sheet amount of remaining sheets reaches the prescribed one, the control section can stop the operation of sheet feeding from the aforesaid sheet feed tray while leaving sheets in the sheet feed tray.

The sheet amount of remaining sheets in the sheet feed tray can be calculated by counting of sheet feeding by a control section in addition to using the above detection section as in-tray sheet amount detecting section 5.

Figure 12:
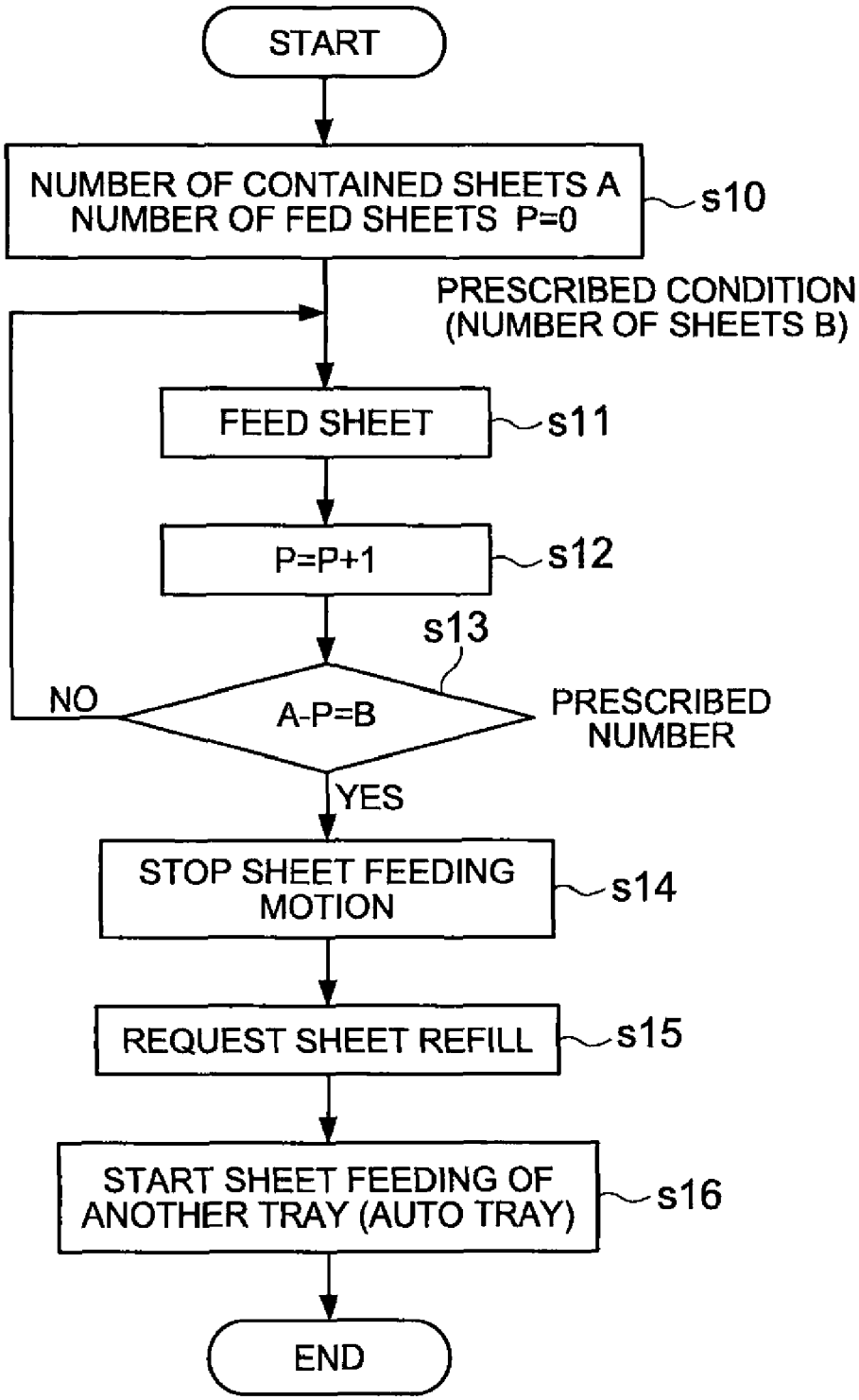
FIG. 12 is a flowchart of the present invention showing steps of another example in which information on an in-tray sheet amount is obtained by another method, and a sheet feeding and a stop of sheet feeding, and an auto tray switch are carried out.

FIG. 12 shows controlling steps, at that time, of the sheet feeding, the stop of the sheet feeding, and the auto tray switch.

The control section obtains the number of sheets A which are stored, in advance, in the sheet feed tray (step s10). The obtaining methods include an acquisition of the number of sheets which has previously been set as the number of sheets at the time of sheets being fully loaded, and an acquisition of the number of sheets which was detected by a sensor capable of detecting the prescribed number of sheets, when the sheets reach the prescribed number. In addition, the number of sheets B has been set as the above prescribed condition.

The control section conducts sheet feeding for every sheet as a continuous sheet feeding (step s11) and at the same time counts the accumulated number of sheet feeding "p" (step s12). Accompanying the aforesaid counting, the number of remaining sheets (A−p) is calculated, and it is judged whether or not the aforesaid number of remaining sheets has reached the number which satisfies the prescribed condition B (step s13). In the case where the number of remaining sheets does not satisfy the prescribed number of sheets (step s13, NO), the sheet feeding (step s11) and the counting of the number of sheet feeding (step s12) are continued. In the case where the number of remaining sheets satisfies the prescribed number of sheets (step s13, YES), the sheet feeding operation from the aforesaid sheet feed tray stops (step s14), and a request of sheet refill is displayed at the operation display section in a similar way to the above steps (step s15). Accompanying the above sheet feeding operation stop, an auto tray switch is conducted (step s16). The steps of the auto tray switch are similar to those described above.

As described above, even without using a sensor which detects an amount of sheets in a sheet feed tray one by one, the stop of sheet feeding, and the control of auto tray switch of the present embodiment can also be executed by using counting of the number of sheets feeding at the control section.

Figure 13A:
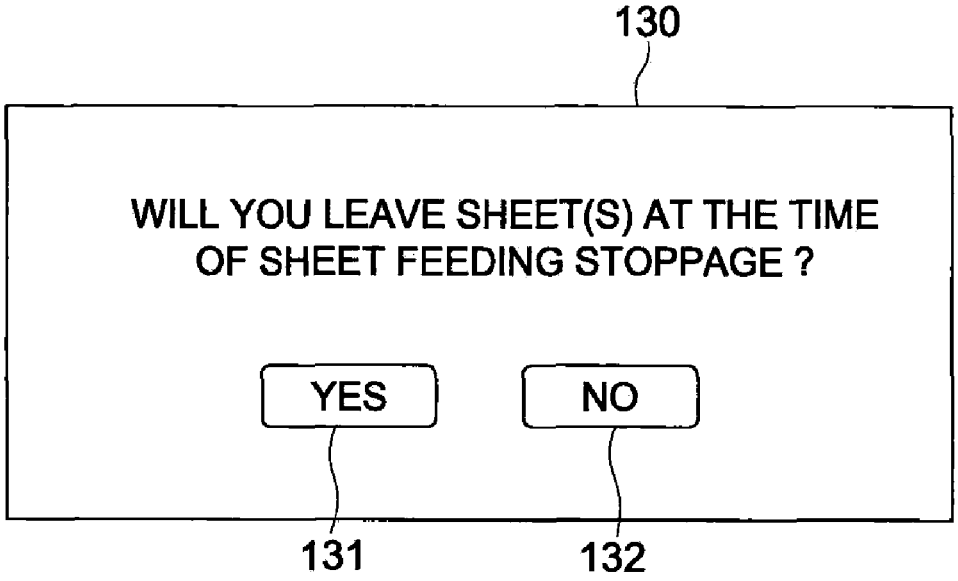
FIGS. 13*a* and 13*b* are examples of the present invention showing an operation screen in which setting of existence or nonexistence of remaining sheets is carried out and an operation screen in which a prescribed condition is changed at an operation display section.

At the above stop of sheet feeding, it is possible to set so as not to leave sheets if desired. With this setting, the sheet feeding operation can be stopped with sheets being left only when it is required. FIG. 13*a* displays, as an example, remaining sheet setting screen 130, which enables the above setting at the operation display section. The setting by the remaining sheet setting screen may be configured to be carried out for every sheet feed job, or to be carried out as a setting of the apparatus. On the aforesaid operation screen, the setting can be easily made by setting whether or not sheets are left, at the time of stop of the sheet feeding, by pushing "YES" button 131 or "NO" button 132. It is possible to make a setting appropriately by enabling the operation screen to be read from the setting screen.

Figure 13B:
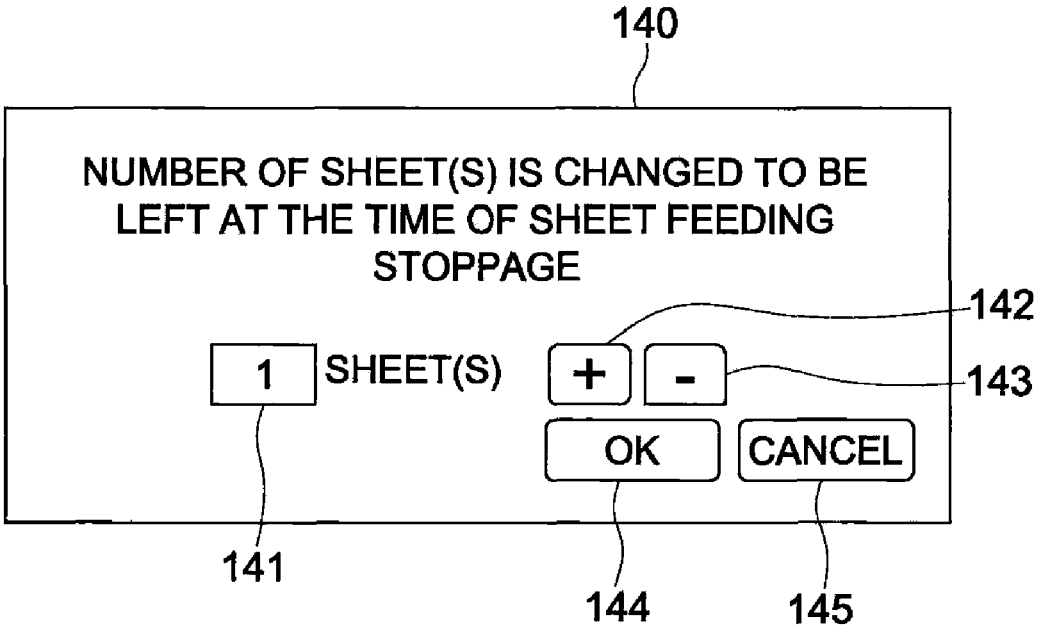

Also the above-described prescribed condition may be made changeable. FIG. 13*b* shows, as an example, remaining sheet condition setting screen 140, which sets the number of sheets as a prescribed condition in the operation display section. In setting number display section 141, the setting number of sheets is displayed. For this, an increase or decrease of the number of sheet can be changed by pushing sheet number increase button 142, or sheet number decrease button 143. The number of sheets changed can be fixed by "OK" button 144, and the number of sheets can be returned to the number before changed by "CANCEL" button 145.

The above prescribed condition is not limited to a specific condition as the present embodiment, but it is desirable not to set to a larger number of sheets than necessary, and the number of sheets of about 1 to 3 is appropriate. Whether or not the motion of leaving sheets in a tray is executed can be done by the above number setting, and if the number of sheet is set to zero, it is also possible to control not to leave sheets at the time of stopping the sheet feeding. If it is set to zero, generation of unnecessary remaining sheets can be prevented. If it is set to one, by confirming the remaining sheet, the type of sheet used can be easily and rapidly confirmed with the minimum number of sheet. Further, if it is set to two, by checking the remaining sheets, the type of sheet used in the corresponding tray can be confirmed, and at the same time, one sheet can be left in the sheet feed tray, even if one of the corresponding sheets is carried away to places such as a sheet storage place. With three sheets and more, at least one sheet can be left in the sheet feed tray, even if one or more of the corresponding sheets are carried away.

Whether or not the motion of leaving sheets in a tray is executed, which was described above, can also be decided based on the number of sheets unprinted in the current job and the number of sheets contained in a new sheet feed tray after switching by an auto tray switch.

Figure 14:
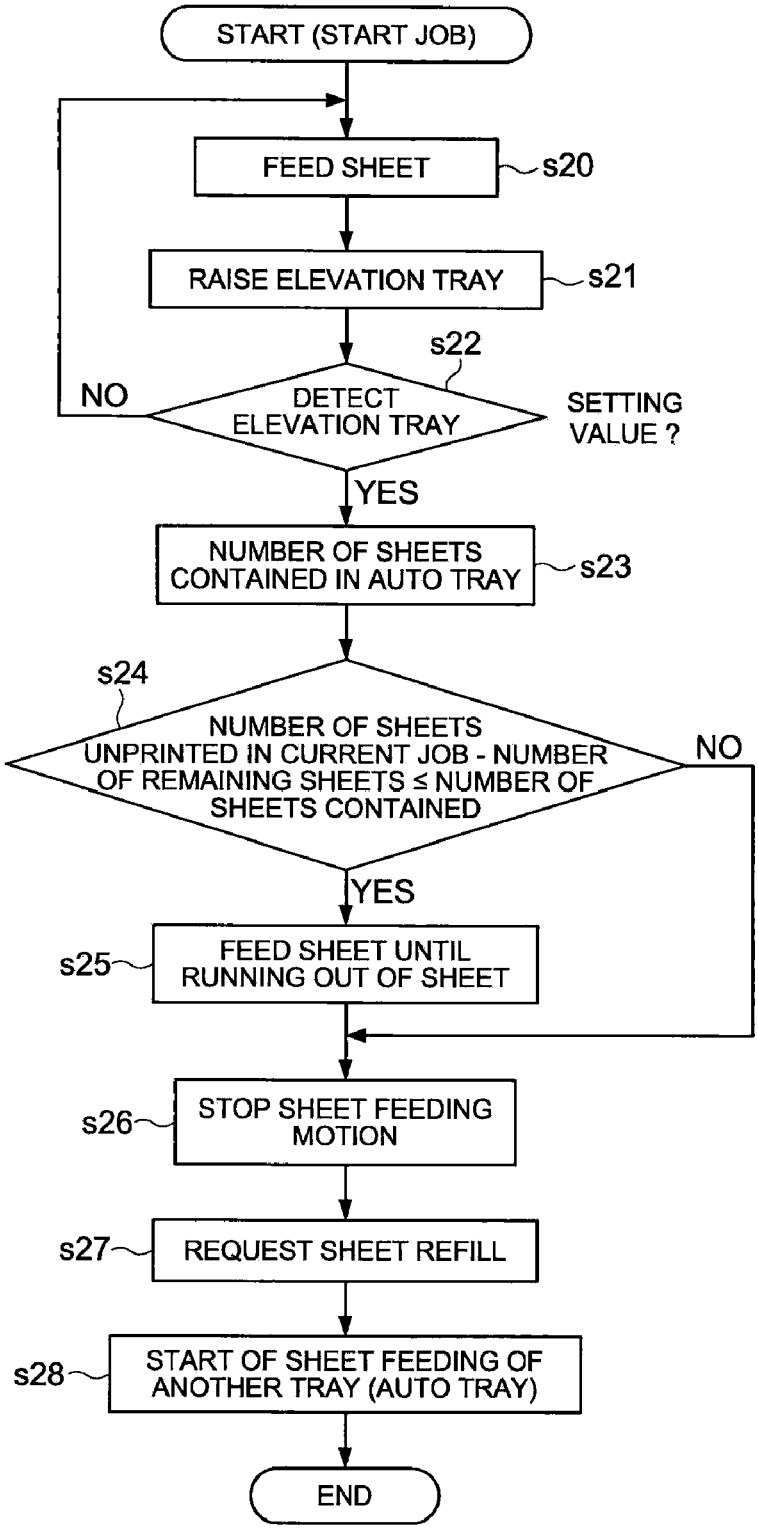
FIG. 14 is a flowchart of an embodiment of the present invention showing steps in which it is decided whether or not to leave sheets at the time of execution of an auto tray switch, and after that a stop of sheet feeding and an auto tray switch are carried out.

Control steps of the case where a setting of the aforesaid decision is made is described with reference to the flowchart of FIG. 14.

As a continuous sheet feeding, as described above, a sheet sending by a sheet feeding section (a sheet feeding) is carried out (step s20), and accompanying the sheet sending, an elevation tray rises (step s21). At the time when the elevation tray successively rises, whether or not the upper surface of the elevation tray reached a detection position is detected by an elevation tray detection sensor (step s22). If the elevation tray is not detected by the elevation tray detection sensor (step s22, NO), since sheets whose number exceeds the prescribed number are stored in the sheet feed tray, the above-described sheet feeding (step s20) and the rise of elevation tray (step s21) are repeated.

When the elevation tray reaches a position where it is detected by the elevation tray detection sensor (step s22, YES), the number of sheets contained in the sheet feed tray becomes the prescribed number of sheets. Therefore, the control section judges that the number of sheets in the sheet feed tray satisfies the prescribed condition.

According to this judgment, the control section decides a new sheet feed tray after switching by an auto tray switch. The decision of the aforesaid tray can be made by a judgment of existence or nonexistence of the fixed tray or by a search of a sheet feed tray, in a similar manner to the above-described FIG. 10. When a new sheet feed tray after switching is determined, the number of sheets contained in the aforesaid sheet feed tray is counted (step s23). The aforesaid number of sheets contained can be acquired by the detection of an amount of remaining sheets described above.

Next, the prescribed number of sheets in the sheet feed tray is subtracted from the number of sheets unprinted in the current job, when the above prescribed condition is satisfied. Whether or not the number of the sheets remaining after the subtraction is less than or equal to the above number of sheets contained in the new tray is judged (step s24). When the number of the sheets after the subtraction is less than or equal to the above number of sheets contained (step s24, YES), the sheets in the sheet feed tray, which was judged to be the prescribed number of sheets, are fed until the sheets run out (step s25). After that, the motion of the sheet feeding section stops (step s26). On the other hand, when the above number of the sheets after the subtraction exceeds the above number of sheets contained (step s24, NO), the motion of the sheet feeding section stops (step s26), while leaving sheets of the above prescribed number. The control section, as described above, displays a request of sheet refill in the operation display section (step s27), and executes an auto tray switch (step s28).

In the above embodiment, a constitution of a roller sheet feeding as a sheet feeding section was described, but as the present invention, the constitution of the sheet feeding section is not limited to a specific one. An example of a sheet feeding by air will be described below.

Figure 15:
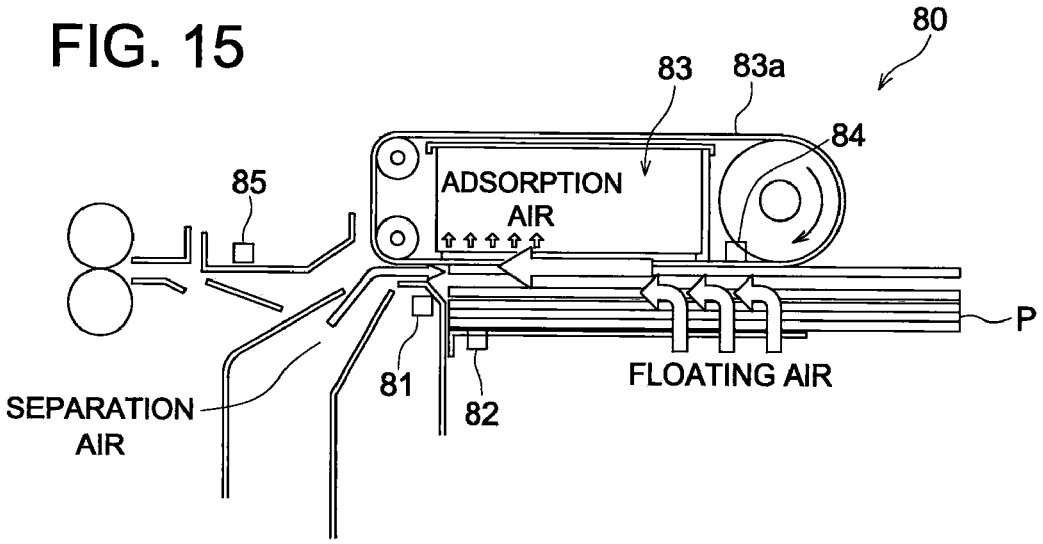
FIG. 15 is an example of the present invention showing a sheet feeding section in which a sheet feeding by air is carried out, and an in-tray sheet amount detecting section.

As shown in FIG. 15, sheet feeding section 80 is configured so that floating air, which floats sheet P in a sheet feed tray, can be supplied, and is provided with upper limit detection sensor 81, which detects the uppermost surface of sheet P floated by the aforesaid floating air. In addition, no-sheet (sheet existence or nonexistence) detection sensor 82, which detects sheets existing in the floating area, is provided as a sheet existence-nonexistence detecting section, and can detect existence or nonexistence of a sheet, regardless of floating or non-floating of the sheet. Upper limit detection sensor 81 detects that a sheet of the uppermost surface is located at a position where sheet feeding is possible, and floating air is regulated so that the aforesaid detection can be achieved.

In the upper side of the above floating area, air adsorption section 83 is located, which inhales air so as to obtain adsorption air, and aforesaid air adsorption section 83 is provided with adsorption belt 83*a*, which sends an adsorbed sheet while adsorbing it. In the vicinity of air adsorption section 83, adsorption sensor 84, which detects a sheet adsorbed at air adsorption section 83, is provided as an adsorption detecting section. It is configured that separation air, which separates a sheet which floats with being overlapped with a sheet to be fed from the sheet to be fed, can be supplied to a space between the floating air and the adsorption air.

On the sheet feeding downstream side where a sheet is sent by adsorption belt 83*a*, there is provided sheet feeding detection sensor 85 which detects a sheet being fed. Above no-sheet (sheet existence or nonexistence) detection sensor 82 and adsorption sensor 84 constitute the in-tray sheet amount detecting section of the present embodiment. In addition, in this example, the number of sheet of the prescribed condition is set to one.

Figure 16:
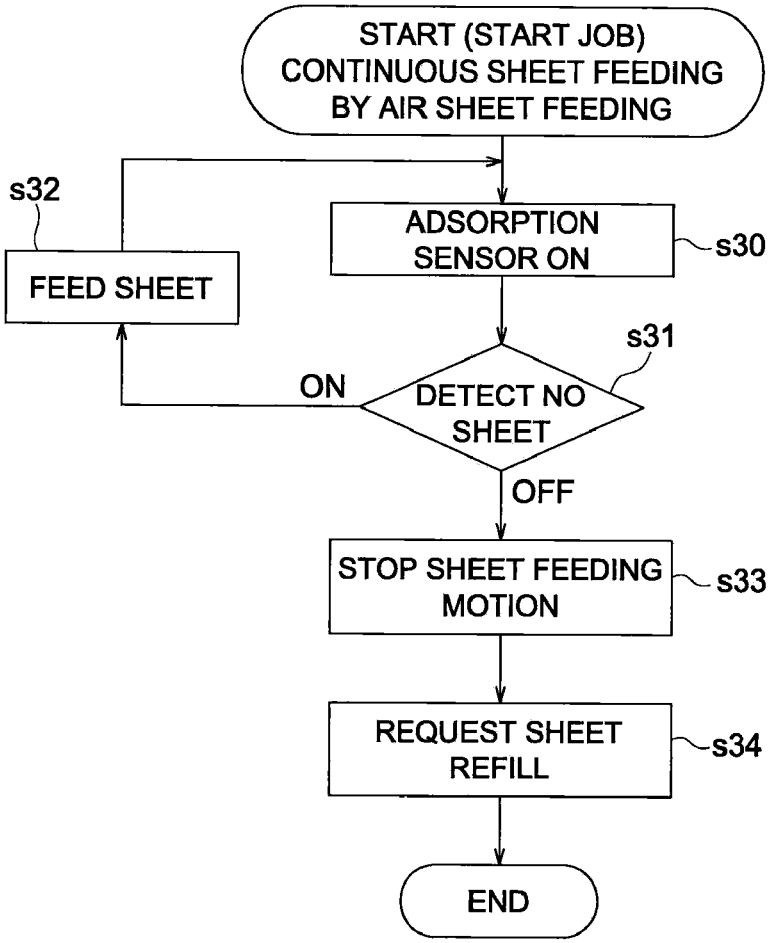
FIG. 16 is a flowchart of an embodiment of the present invention showing steps of a sheet feeding by air and a stop of sheet feeding.

Next, steps of a sheet feeding and a stop of a sheet feeding in above sheet feeding section 80 will be described with reference to the flowchart of FIG. 16.

According to a start of continuous sheet feeding using a sheet feeding by air by a control section, sheet P floated by air is adsorbed by air at air adsorption section 83, and the aforesaid sheet is detected by adsorption sensor 84 (step s30). At this time, it is judged whether or not the sheet has been detected by no-sheet (sheet existence or nonexistence) detection sensor 82 (step s31). If the detection result of no-sheet (sheet existence or nonexistence) detection sensor 82 is ON (step s31, ON), at least one sheet existing in the floating area and one adsorbed sheet remain in the sheet feed tray, and it means that at least two sheets remain in the sheet feed tray.

Since an amount of sheets in the sheet feed tray does not satisfy the prescribed condition (one sheet), the control section conducts a sheet feeding so as to send a sheet adsorbed by air (step s32), and continues a continuous sheet feeding (to step s30). For the next sheet adsorption, it is judged, in a similar manner, whether or not a sheet has been detected by no-sheet (sheet existence or nonexistence) detection sensor 82 (step s31).

Here, if the detection result of no-sheet (sheet existence or nonexistence) detection sensor 82 becomes OFF (step s31, OFF), it means that no sheet remains in the floating area and only one adsorbed sheet remains in the sheet feed tray. At this time, since an amount of sheets in the sheet feed tray satisfies the prescribed condition (one sheet), the control section stops the sheet feeding motion and the supply of each of the air (step s33). As a result, the sheet adsorbed on air adsorption section 83 comes off from air adsorption section 83, and falls to the bottom side of the sheet feed tray to become a remaining sheet. Further, the control section urges the operator to refill sheets by displaying a request of sheet refill in the operation display section (step s34). After that, if an auto tray switch function is effective, the auto tray switch is carried out, though it is not illustrated.

So far, based on each of the above embodiments, the present invention was described, but the present invention is not limited to the contents of the above embodiments, and naturally, appropriate changes and modification may be made without departing from the scope of the invention.

As described above, according to the sheet feeding device or the image forming apparatus of the present embodiments, there are provided a plurality of sheet feed tray in which sheets are stored, a sheet feeding section which enables a continuous sheet feeding of sheets stored in the above sheet feed tray, and a control section which controls the above sheet feeding section and, in the image forming apparatus, controls motions of the image forming section, and has an auto tray switch function. The aforesaid control section obtains information about an amount of sheets stored in the above sheet feed tray, during a continuous sheet feeding from the above sheet feed tray, and judges whether or not the amount of the remaining sheets in the above sheet feed tray satisfies the prescribed condition. As a result of the aforesaid judgment, when the above prescribed condition is satisfied, the control section stops motion of sheet feeding from the above sheet feed tray while leaving sheets in the above sheet feed tray. Further, when the above auto tray switch function is effective, the control section stops an operation of sheet feeding from the above sheet feed tray, and, at the same time, starts motion of sheet feeding from other sheet feed tray having the same settings of sheet information to continue a continuous sheet feeding. Therefore, when the number of sheets stored in the current sheet tray is insufficient compared to the number of sheets required for sheet feeding during the continuous sheet feeding, the control section can stop the motion of sheet feeding from the aforesaid sheet feed tray while leaving sheets in the aforesaid sheet feed tray, and it becomes possible to rapidly determine the current sheets in the sheet feed tray using the remaining sheet, to result in an effect of preventing an error to refill sheets of a different type from those before the refill. Further, it is possible to reduce an amount of remaining sheets to the minimum necessary number, by setting properly the prescribed condition.

Further, in the present embodiments, the above motion of leaving sheets in a tray can be executed, and at the same time, the auto tray switch to the other sheet feed tray in which sheets having the same conditions as those of the aforesaid remaining sheets can be carried out. Therefore, without stopping the apparatus, it becomes possible to make visual confirmation using the above remaining sheets and to confirm the remaining sheets without reducing productivity.

What is claimed is:

1. A sheet feeding device comprising:

a plurality of sheet feed trays in which sheets are stored;

a sheet feeding section which is capable of continuous sheet feeding of sheets stored in the plurality of sheet feed trays; and a control section which controls motion of the sheet feeding section and has an auto tray switch function, wherein the control section, during the continuous sheet feeding from a first sheet feed tray among the plurality of sheet feed trays, obtains information about a sheet amount of sheets being stored in the first sheet feed tray and judges whether or not an amount of sheets remaining in the first sheet feed tray satisfies a prescribed condition, and wherein when the prescribed condition is satisfied as a result of the judgment, the control section stops motion of feeding a sheet from the first sheet feed tray while keeping a sheet left in the first sheet feed tray, and in addition, when the auto tray switch function is effective, as well as stopping the motion of feeding a sheet from the first sheet feed tray, the control section starts motion of feeding a sheet from a second sheet feed tray whose setting of sheet information is identical to the first sheet feed tray so that continuous sheet feeding is continued;

wherein the control section determines whether or not to conduct the auto tray switch while keeping a sheet left in the first sheet feed tray when the amount of remaining sheets in the first sheet feed tray satisfies the prescribed condition, based on a number of the remaining sheets in the first sheet feed tray, a number of unprinted sheets of a current job and a number of sheets in the second sheet feed tray which is set as a destination of the auto tray switch.

2. The sheet feeding device of claim 1 further comprising:

an in-tray sheet amount detecting section which detects a sheet amount of sheets stored in the first sheet feed tray, wherein the control section obtains the information about the sheet amount of sheets by receiving a result of the detection of the in-tray sheet amount detecting section.

3. The sheet feeding device of claim 2, wherein the prescribed condition is a condition in which detection of sheet absence is made by the in-tray sheet amount detecting section immediately after detection of sheet existence is made by the in-tray sheet amount detecting section.

4. The sheet feeding device of claim 2, wherein the sheet feeding section comprises:

an air adsorption section which feeds a sheet in the first sheet feed tray by adsorbing the sheet by air;

an adsorption detection section which detects a sheet adsorbed by the air adsorption section; and a sheet existence-nonexistence detecting section which detects existence or nonexistence of the sheet in the first sheet feed tray prior to the air adsorption, the adsorption detection section and the sheet existence-nonexistence detecting section being included in the in-tray sheet amount detecting section, wherein when the adsorption detection section detects the sheet adsorbed and the sheet existence-nonexistence detecting section detects nonexistence of the sheet, the control section judges that the prescribed condition is satisfied, and then leaves the sheet adsorbed by the air adsorption section in the first sheet feed tray by terminating adsorbing motion of the air adsorption section.

5. The sheet feeding device of claim 1, wherein the control section obtains the information about the sheet amount by calculating a sheet amount of sheets stored in the first sheet feed tray from a sheet amount of sheets which has been fed from the first sheet feed tray and a sheet amount of sheets in the first sheet feed tray before the sheet feeding.

6. The sheet feeding device of claim 1, wherein when the prescribed condition is satisfied, the control section gives or makes at least one of a notice of sheet absence, a request of sheet removal, a request of sheet transfer and a request of sheet refill for the first sheet tray.

7. The sheet feeding device of claim 6, wherein when the prescribed condition is satisfied, the control section gives the notice or makes the request every prescribed period, every prescribed number of printed sheets or every prescribed number of jobs.

8. The sheet feeding device of claim 1, wherein the control section notifies of another sheet feed tray having an identical setting to the first sheet feed tray when absence of sheet is detected in the first sheet feed tray in which a sheet is left when the prescribed condition is satisfied.

9. The sheet feeding device of claim 1, wherein the prescribed condition is a condition in which the sheet amount of remaining sheets is less than or equal to the prescribed number of sheets.

10. The sheet feeding device of claim 1, wherein the prescribed condition can be set for each type of the sheet.

11. The sheet feeding device of claim 1, wherein the control section enables setting to select whether or not the sheet feeding motion stops with leaving a sheet in the first sheet feed tray when the prescribed condition is satisfied.

12. The sheet feeding device of claim 1, wherein the control section enables setting to determine, for each of the plurality of sheet feed trays, whether the each sheet feed tray leaves a sheet in the each sheet feed tray or does not leave a sheet in the each sheet feed tray when the prescribed condition is satisfied.

13. The sheet feeding device of claim 1, wherein the sheet feeding device is connected with an external apparatus to which the sheet is fed from the sheet feeding device and wherein the control section is provided in the external apparatus and controls the external apparatus.

14. The sheet feeding device of claim 1, wherein the control section can conduct setting of effectiveness and ineffectiveness selection of the auto tray switch function while keeping a sheet left in the first sheet feed tray during at least one of a period between jobs and a period of job execution.

15. The sheet feeding device of claim 1, wherein the control section can conduct setting of effectiveness and ineffectiveness selection of the auto tray switch function while keeping a sheet left in the first sheet feed tray for each of the plurality of sheet feed trays.

16. The sheet feeding device of claim 1, wherein the control section feeds a sheet from the first sheet feed tray without leaving a sheet in the first sheet feed tray and conducts the auto tray switch to the second sheet feed tray according to running out of a sheet in the first sheet feed tray when the number of sheets in the second sheet feed tray is greater than a number of sheets after subtraction of the number of the remaining sheets in the first sheet feed tray from the number of the unprinted sheets of the current job and the auto tray switch function is effective.

17. An image forming apparatus comprising:

the sheet feeding device of claim 1; and an image forming section for forming an image on a sheet fed from the sheet feeding device, wherein the control section controls motion of the image forming section and the sheet feeding section.

18. The image forming apparatus of claim 17, wherein the sheet feeding device includes an insertion device which feeds another sheet for insertion onto the sheet on which an image has been formed by the image forming section.

19. The image forming apparatus of claim 17, wherein the sheet feeding device is provided so as to be under at least one of a condition where the sheet feeding device is included inside a body of the image forming apparatus and a condition where the sheet feeding device is connected externally with the body of the image forming apparatus.

20. A sheet feeding device comprising:

a plurality of sheet feed trays in which sheets are stored;

a sheet feeding section which is capable of continuous sheet feeding of sheets stored in the plurality of sheet feed trays; and a control section which controls motion of the sheet feeding section and has an auto tray switch function;

wherein the control section, during the continuous sheet feeding from a first sheet feed tray among the plurality of sheet feed trays, obtains information about a sheet amount of sheets being stored in the first sheet feed tray and judges whether or not an amount of sheets remaining in the first sheet feed tray satisfies a prescribed condition, wherein when the prescribed condition is satisfied as a result of the judgment, the control section stops motion of feeding a sheet from the first sheet feed tray while keeping a sheet left in the first sheet feed tray, and in addition, when the auto tray switch function is effective, as well as stopping the motion of feeding a sheet from the first sheet feed tray, the control section starts motion of feeding a sheet from a second sheet feed tray whose setting of sheet information is identical to the first sheet feed tray so that continuous sheet feeding is continued, and wherein the sheet feeding section comprises:

an air adsorption section which feeds a sheet in the first sheet feed tray by adsorbing the sheet by air;

an adsorption detection section which detects a sheet adsorbed by the air adsorption section; and a sheet existence-nonexistence detecting section which detects existence or nonexistence of the sheet in the first sheet feed tray prior to the air adsorption, the adsorption detection section and the sheet existence-nonexistence detecting section being included in an in-tray sheet amount detecting section which detects a sheet amount of sheets stored in the first sheet feed tray, wherein when the adsorption detection section detects the sheet adsorbed and the sheet existence-nonexistence detecting section detects nonexistence of the sheet, the controls section judges that the prescribed condition is satisfied, and then leaves the sheet adsorbed by the air adsorption section in the first sheet feed tray by terminating adsorbing motion of the air adsorption section.

* * * * *